US008965665B2

(12) United States Patent
Iwazaki et al.

(10) Patent No.: US 8,965,665 B2
(45) Date of Patent: Feb. 24, 2015

(54) AIR-FUEL RATIO IMBALANCE DETERMINING APPARATUS AMONG CYLINDERS FOR AN INTERNAL COMBUSTION ENGINE

(75) Inventors: Yasushi Iwazaki, Ebina (JP); Hiroshi Miyamoto, Susono (JP); Fumihiko Nakamura, Susono (JP); Hiroshi Sawada, Gotenba (JP); Toru Kidokoro, Hadano (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 409 days.

(21) Appl. No.: 13/389,082

(22) PCT Filed: Aug. 6, 2009

(86) PCT No.: PCT/JP2009/064281

§ 371 (c)(1),
(2), (4) Date: Mar. 13, 2012

(87) PCT Pub. No.: WO2011/016145

PCT Pub. Date: Feb. 10, 2011

(65) Prior Publication Data

US 2012/0173116 A1 Jul. 5, 2012

(51) Int. Cl.

| | |
|---|---|
| ***F02D 41/22*** | (2006.01) |
| ***F02D 41/00*** | (2006.01) |
| ***F02D 41/14*** | (2006.01) |

(52) U.S. Cl.

CPC ..... *F02D 41/008* (2013.01); *F02D 41/1456* (2013.01)

USPC ..... 701/107; 123/672; 123/690

(58) Field of Classification Search

CPC ..... F02D 41/008; F02D 41/0085; F02D 41/1456; F02D 41/1495; F02D 41/22

USPC ..... 123/672, 688, 690; 701/103, 107, 109; 60/276, 277; 73/114.71, 114.72

See application file for complete search history.

(56) References Cited

U.S. PATENT DOCUMENTS

| | | | |
|---|---|---|---|
| 5,964,208 | A | 10/1999 | Yamashita et al. |
| 6,032,659 | A | 3/2000 | Yamashita et al. |

(Continued)

FOREIGN PATENT DOCUMENTS

| | | | |
|---|---|---|---|
| JP | 10 169501 | | 6/1998 |
| JP | 2007-113515 | A | 5/2007 |

(Continued)

OTHER PUBLICATIONS

International Search Report Issued Oct. 13, 2009 in PCT/JP09/64281 Filed Aug. 6, 2009.

*Primary Examiner* — Hai Huynh

(74) *Attorney, Agent, or Firm* — Oblon, Spivak, McClelland, Maier & Neustadt, L.L.P.

(57) ABSTRACT

An air-fuel ratio imbalance among cylinders determining apparatus according to the present invention obtains an output Vabyfs of an air-fuel ratio sensor disposed at a portion downstream of an exhaust gas aggregated portion of an exhaust gas passage, and obtains a second-order differential value d2AF (a change rate of a change rate of a detected air-fuel ratio abyfs) of a detected air-fuel ratio abyfs represented by the air-fuel ratio sensor output Vabyfs. The imbalance determining apparatus determines that an air-fuel ratio imbalance state among cylinders is occurring when a detected air-fuel ratio second-order differential corresponding value (for example, a second-order differential value d2AF per se) obtained in accordance with the second-order differential value d2AF is larger than a first threshold value.

7 Claims, 15 Drawing Sheets

(56) References Cited

U.S. PATENT DOCUMENTS

| | | | | |
|---|---|---|---|---|
| 6,314,952 | B1 | 11/2001 | Turin et al. | |
| 7,027,910 | B1 | 4/2006 | Javaherian et al. | |
| 7,152,594 | B2 | 12/2006 | Anilovich et al. | |
| 7,483,781 | B2 * | 1/2009 | Wakahara et al. | 701/103 |
| 8,401,766 | B2 * | 3/2013 | Iwazaki et al. | 701/109 |
| 8,452,521 | B2 * | 5/2013 | Iwazaki et al. | 701/103 |
| 2008/0110447 | A1 | 5/2008 | Wakahara et al. | |
| 2009/0037079 | A1 | 2/2009 | Suzuki et al. | |
| 2011/0308506 | A1 * | 12/2011 | Hayashita et al. | 123/703 |
| 2013/0138329 | A1 * | 5/2013 | Aoki | 701/104 |
| 2013/0325296 | A1 * | 12/2013 | Koshi et al. | 701/104 |

FOREIGN PATENT DOCUMENTS

| | | |
|---|---|---|
| JP | 2007 154840 | 6/2007 |
| JP | 2007 303354 | 11/2007 |
| JP | 2008 121533 | 5/2008 |
| JP | 2009 13967 | 1/2009 |

* cited by examiner

AIR-FUEL RATIO IMBALANCE DETERMINING APPARATUS AMONG CYLINDERS FOR AN INTERNAL COMBUSTION ENGINE

TECHNICAL FIELD

The present invention relates to an "air-fuel ratio imbalance among cylinders determining apparatus for an internal combustion engine", which is applied to a multi-cylinder internal combustion engine, and which can determine (or monitor, detect) whether or not an excessive imbalance among air-fuel ratios (air-fuel ratios of individual cylinders) of air-fuel mixtures, each of which is supplied to each of cylinders, is occurring (whether or not an air-fuel ratio imbalance state among cylinders is occurring).

BACKGROUND ART

Conventionally, an air-fuel ratio controlling apparatus has been widely known, which is provided with a three-way catalyst disposed in an exhaust gas passage of an internal combustion engine, and an upstream air-fuel ratio sensor and a downstream air-fuel ratio sensor disposed upstream and downstream, respectively, of the three-way catalyst in the exhaust gas passage. This air-fuel ratio controlling apparatus calculates an air-fuel ratio feedback amount based on an output of the upstream air-fuel ratio sensor and an output of the downstream air-fuel ratio sensor, and performs a feedback control upon an air-fuel ratio (air-fuel ratio of the engine) of air-fuel mixtures supplied to the engine using the air-fuel ratio feedback amount, in such a manner that the air-fuel ratio of the engine coincides with a stoichiometric air-fuel ratio. Further, an air-fuel ratio controlling apparatus has been suggested, which calculates an air-fuel ratio feedback amount based on only one of the output of the upstream air-fuel ratio sensor and the output of the downstream air-fuel ratio sensor, and performs a feedback control upon the air-fuel ratio of the engine using the air-fuel ratio feedback amount. The air-fuel ratio feedback amount used in such air-fuel ratio controlling apparatuses is a control amount commonly used to all of the cylinders.

Incidentally, an electronically-controlled fuel injection type internal combustion engine is generally provided with at least one fuel injector in each of the cylinders or in each of intake ports each communicating with one of the cylinders. Therefore, when a characteristic (or property) of the fuel injector of a specific cylinder becomes a "characteristic that the specific injector injects a more excessive amount of fuel than an instructed fuel injection amount", only the air-fuel ratio of an air-fuel mixture supplied to that specific cylinder (the air-fuel ratio of that specific cylinder) shifts to an extremely richer side. That is, a non-uniformity among air-fuel ratios of the cylinders (deviation in air-fuel ratio among the cylinders, an air-fuel ratio imbalance among the cylinders) becomes large. In other words, an imbalance is generated in the air-fuel ratios of individual cylinders.

In this case, the average of the air-fuel ratios of the air-fuel mixtures supplied to the entire engine becomes an air-fuel ratio richer than the stoichiometric air-fuel ratio. Therefore, the air-fuel ratio feedback amount commonly used for all the cylinders causes the air-fuel ratio of the above-mentioned specific cylinder to shift to a leaner side, so that the air-fuel ratio of the specific cylinder becomes closer to the stoichiometric air-fuel ratio, and simultaneously, causes the air-fuel ratios of the other cylinders to shift to a richer side, so that the air-fuel ratios of the other cylinders deviate from the stoichiometric air-fuel ratio. As a result, an average of the air-fuel ratios of the air-fuel mixtures supplied to the entire engine becomes approximately equal to the stoichiometric air-fuel ratio.

However, the air-fuel ratio of the above-mentioned specific cylinder is still in a richer side with respect to the stoichiometric air-fuel ratio, and the air-fuel ratios of the other cylinders are still in a leaner side with respect to the stoichiometric air-fuel ratio, so that the combustion state of the air-fuel mixture in each of the cylinders is different from its perfect (complete) combustion state. As a result, an amount of emissions (an amount of unburnt substances and an amount of nitrogen oxides) discharged from each of the cylinders increases. Therefore, even when the average of the air-fuel ratios of the air-fuel mixtures supplied to the engine coincides with the stoichiometric air-fuel ratio, the three-way catalyst cannot purify the increased emissions, so that there is a possibility that the missions become worse.

Therefore, it is important to detect that the non-uniformity among the air-fuel ratios of the cylinders becomes excessive (generation of an imbalance state in air-fuel ratio among the cylinders), since some measures can be taken in order not to worsen the emissions. Note that an imbalance state in air-fuel ratio among the cylinders is generated due to various factors such as a case where the characteristic of the fuel injector of the specific cylinder becomes a "characteristic that the injector injects an excessively small amount of fuel than the instructed fuel injection amount", or a case where distribution of an EGR gas and an evaporated fuel gas to each of the cylinders becomes non-uniform.

One of such prior art apparatuses for determining whether or not the non-uniformity among air-fuel ratios of the cylinders has occurred is configured so as to obtain a locus (trajectory) length of the output (output signal) of an air-fuel ratio sensor (the above-mentioned upstream air-fuel ratio sensor) disposed at an exhaust gas aggregated portion where exhaust gases from the plurality of cylinders are aggregated, and to compare the locus length with a "reference value varying in accordance with an engine rotational speed and an intake air amount", and to determine whether or not the imbalance state in the air-fuel ratios among the cylinders has occurred in accordance with the comparison result (for example, refer to U.S. Pat. No. 7,152,592). It should be noted that, in the present specification, the determination of whether or not an imbalance state in air-fuel ratios among cylinders has occurred is also simply referred to as an "air-fuel ratio imbalance among cylinders determination", or an "imbalance determination".

SUMMARY OF THE INVENTION

In a case where an air-fuel ratio imbalance state among cylinders is occurring, the output of the air-fuel ratio sensor obtained when an exhaust gas from a cylinder whose individual air-fuel ratio does not deviate from the stoichiometric air-fuel ratio reaches the air-fuel ratio sensor greatly differs from the output of the air-fuel ratio sensor obtained when an exhaust gas from a cylinder whose individual air-fuel ratio greatly deviates to a richer side or a leaner side with respect to the stoichiometric air-fuel ratio reaches the air-fuel ratio sensor. Therefore, when the air-fuel ratio imbalance state among cylinders occurs, the locus length of the output of the air-fuel ratio sensor increases.

However, even when the air-fuel ratio imbalance state among cylinders is not occurring, if the air-fuel ratio of the engine fluctuates, for example, in a case where the load of the engine rapidly changes or the like, the locus length of the air-fuel ratio sensor output also varies by that fluctuation of the air-fuel ratio. This point is explained with reference to FIG. 1.

FIG. 1 is a timing chart showing changes (behaviors) of: (A) a crank angle; (B) a detected air-fuel ratio in a case in which there is no fluctuation in the average air-fuel ratio (the center air-fuel ratio) of the engine, but an air-fuel ratio imbalance state among cylinders has occurred; (C) a detected air-fuel ratio where an air-fuel ratio imbalance state among cylinders is not occurring, but the center air-fuel ratio of the engine has fluctuated; (D) a locus length of the absolute value of the detected air-fuel ratio; (E) an absolute value of a second-order differential (derivative) value of the detected air-fuel ratio with respect to time; and (F) a second-order differential value of the detected air-fuel ratio with respect to time. Note that the detected air-fuel ratio is a value obtained by converting the output of the air-fuel ratio sensor into an air-fuel ratio, and is substantially in proportion to the output of the air-fuel ratio sensor.

When no fluctuation is occurring in the center air-fuel ratio of the engine, but an air-fuel ratio imbalance state among cylinders is occurring, the detected air-fuel ratio, for example, as shown in (B) of FIG. 1, greatly fluctuates between "a maximum value (for example, refer to time t5) and a minimum value (for example, refer to time t6)" in a "unit combustion cycle time period (a time period for which the crank angle increases by 720° in a four-cylinder/four-cycle engine) ". On the other hand, when an air-fuel ratio imbalance state among cylinders is not occurring, but the center air-fuel ratio of the engine greatly fluctuates, the detected air-fuel ratio greatly fluctuates as shown in (C) of FIG. 1, for example. Note that one unit combustion cycle time period is a time period required for an arbitrary cylinder to complete "one combustion cycle formed of an intake stroke, a compression stroke, an expansion stroke, and a gas exhaust stroke."

As a result, the length (locus length) of a locus of the absolute value of the detected air-fuel ratio in one unit combustion cycle time period varies as indicated by a solid line in (D) of FIG. 1 when no fluctuation is present in the center air-fuel ratio of the engine and the imbalance state is occurring, and the locus length varies as indicated by dotted line in (D) of FIG. 1 when no imbalance state is occurring but the center air-fuel ratio of the engine fluctuates.

For example, in a period from time t1 to time t4 of FIG. 1, the locus length (solid line) when the imbalance state is occurring is larger than the locus length (broken line) when the center air-fuel ratio fluctuates. However, in a period from time t4 to time t7, the locus length (solid line) when the imbalance state is occurring is smaller than (or roughly equal to) the locus length (broken line) when the center air-fuel ratio fluctuates. As is clear from the above-description, when the locus length is used, it is not always possible to precisely/accurately carry out the air-fuel ratio imbalance determination among cylinders.

The present invention is made to solve the above-mentioned problem. One of objects of the present invention is to provide an air-fuel ratio imbalance among cylinders determining apparatus which can carry out the air-fuel ratio imbalance among cylinders determination more accurately, by using a value (i.e., an air-fuel ratio second-order differential corresponding value) varying in accordance with a "second-order differential value of the detected air-fuel ratio with respect to time".

More specifically, the air-fuel ratio imbalance among cylinders determining apparatus according to the present invention (hereinafter, also referred to as a "present invention apparatus") is applied to a multi-cylinder internal combustion engine having a plurality of cylinders. The present invention apparatus is an apparatus for determining whether or not a "state where a large imbalance (i.e., an air-fuel ratio imbalance state among cylinders)" is occurring among "air-fuel ratios of individual cylinders", each of which is an "air-fuel ratio of each of air-fuel mixtures, each being supplied to each of at least two cylinders (preferable, three or more cylinders)" of a plurality of the cylinders. The present invention apparatus comprises an air-fuel ratio sensor, and imbalance determining means.

The air-fuel ratio sensor is disposed at an "exhaust gas aggregated portion of an exhaust gas passage of the engine" where exhaust gases discharged from the at least two cylinders aggregate or at a "portion downstream of the exhaust gas aggregated portion" in the exhaust gas passage. The air-fuel ratio sensor is a sensor which generates an output, as an air-fuel ratio sensor output, corresponding to an air-fuel ratio of an exhaust gas which has reached the air-fuel ratio sensor.

The imbalance determining means obtains a "second-order differential value" of a "detected air-fuel ratio represented by the air-fuel ratio sensor output" with respect to time based on the air-fuel ratio sensor output, and obtains an air-fuel ratio second-order differential corresponding value which varies in accordance with the obtained second-order differential value, based on the obtained second-order differential value. Further, the imbalance determining means determines whether or not the air-fuel ratio imbalance state among cylinders is occurring based on the "obtained air-fuel ratio second-order differential corresponding value."

The "detected air-fuel ratio represented by the air-fuel ratio sensor output" may be the air-fuel ratio sensor output per se, or a value obtained by converting the air-fuel ratio sensor output into an air-fuel ratio.

As will be described later, the "air-fuel second-order differential corresponding value" may be various values which vary in accordance with the "second-order differential value ($d^2X/dt^2$) of the detected air-fuel ratio (X) represented by the air-fuel ratio sensor output with respect to time."

As shown by solid lines in (E) and (F) of FIG. 1, when the air-fuel ratio imbalance state among cylinders is occurring, the absolute value of the second-order differential value of the detected air-fuel ratio reaches two "values whose absolute values are large" within the single unit combustion cycle period. That is, as shown in (F) of FIG. 1, since the second-order differential value of the detected air-fuel ratio is a differential value of a change rate of the detected air-fuel ratio (a change amount of the detected air-fuel ratio per unit time), the second-order differential value becomes a negative value whose absolute value is large at a time point (time t2, t5, or t8) when a state where the detected air-fuel ratio rapidly increases is changed to a state where the detected air-fuel ratio rapidly decreases, and the second-order differential value becomes a positive value whose absolute value is large at a time point (time t3, t6, or t9) when a state where the detected air-fuel ratio rapidly decreases is changed to a state where the detected air-fuel ratio rapidly increases.

Meanwhile, even when the center air-fuel ratio of the engine rapidly fluctuates, if the air-fuel ratio imbalance state among cylinders is not occurring, the absolute value of the second-order differential value of the detected air-fuel ratio does not become so large as shown by a dotted line in (E) of FIG. 1, since the degree of the fluctuation of the detected air-fuel is milder (slower) as compared with a case where the air-fuel ratio imbalance state among cylinders is occurring.

Therefore, since the air-fuel ratio imbalance among cylinders determining apparatus of the present invention is configured so as to carry out the air-fuel ratio imbalance among cylinders determination using the air-fuel ratio second-order differential corresponding value which shows a peculiar value when the air-fuel ratio imbalance state among cylinders is occurring, the apparatus of the present invention can perform the air-fuel ratio imbalance among cylinders determination more accurately.

In one of aspects of the present invention, the imbalance determining means is configured so as to determine that the air-fuel ratio imbalance state among cylinders is occurring, when an absolute value of the obtained air-fuel ratio second-order differential corresponding value is larger than a first threshold value.

More specifically, the imbalance determining means may be configured so as to obtain the obtained second-order differential value as the air-fuel ratio second-order differential corresponding value.

According to this configuration, the air-fuel ratio second-order differential corresponding value can be obtained by the simple configuration without using a complicated filter or the like.

Alternatively, the imbalance determining means may be configured so as to obtain the "second-order differential values" obtained every elapse of a predetermined time period within the unit combustion cycle period, and so as to obtain, as the "air-fuel ratio second-order differential corresponding value", a "second-order differential value whose absolute value is maximum (or largest)" among a "plurality of the obtained second-order differential values."

That is, the imbalance determining means is configured so as to obtain a plurality of the "second-order differential values of the detected air-fuel ratio" in the unit combustion cycle period by obtaining the "second-order differential values of the detected air-fuel ratio" every time the predetermined time period elapses, and so as to adopt, as the air-fuel differential corresponding value, a second-order differential value having an maximum absolute value among a plurality of the second-order differential values. According to this configuration, as well, the air-fuel ratio second-order differential corresponding value can be obtained by the simple configuration without using a complicated filter or the like.

In another aspect, the imbalance determining means is configured so as to:

obtain, as the air-fuel ratio second-order differential corresponding values, said second-order differential value obtained every elapse of a predetermined time period within the unit combustion cycle period; and determine that the air-fuel ratio imbalance state among cylinders is occurring, when an air-fuel ratio second-order differential corresponding value having a positive value whose absolute value is larger than or equal to a second threshold value exists (is present/is found), and an air-fuel ratio second-order differential corresponding value having a negative value whose absolute value is larger than or equal to a third threshold value exists (is present/is found), among a plurality of the air-fuel ratio second-order differential corresponding values obtained within the unit combustion cycle period.

As is clear from (F) of FIG. 1, when the air-fuel ratio imbalance state among cylinders has occurred, the second-order differential value of the detected air-fuel ratio reaches a positive value whose absolute value is equal to or larger than the predetermined value (second threshold value), and reaches a negative value whose absolute value is equal to or larger than the predetermined value (third threshold value), within one unit combustion cycle period. Therefore, according to the configuration described above, a generation of the air-fuel ratio imbalance state among cylinders can be more certainly determined based on a simple technique.

In still another aspect of the present invention, the imbalance determining means is configured so as to:

obtain, as the air-fuel ratio second-order differential corresponding values, the "second-order differential value" obtained every elapse of a predetermined time period within the unit combustion cycle period;

select a "positive-side maximum air-fuel ratio second-order differential corresponding value (positive-side maximum value) having a positive value whose absolute value is maximum" from (out of) "air-fuel ratio second-order differential values having positive values" among a plurality of the air-fuel ratio second-order differential corresponding values obtained within the unit combustion cycle period;

select a "negative-side maximum air-fuel ratio second-order differential corresponding value (negative-side maximum value) having a negative value whose absolute value is maximum" from (out of) "air-fuel ratio second-order differential values having negative values" among a plurality of the air-fuel ratio second-order differential corresponding values obtained within the unit combustion cycle period; and further, determine that the air-fuel ratio imbalance state among cylinders is occurring when a "product of the positive-side maximum second-order differential corresponding value and the negative-side maximum second-order differential corresponding value" is equal to or smaller than a "predetermined negative threshold value."

As is clear from (F) of FIG. 1, when the air-fuel ratio imbalance state among cylinders has occurred, the second-order differential value of the detected air-fuel ratio reaches a "positive value whose absolute value is equal to or larger than the predetermined value (second threshold value)", and reaches a "negative value whose absolute value is equal to or larger than the predetermined value (third threshold value)", within the single unit combustion cycle period. Accordingly, when the air-fuel ratio imbalance state among cylinders has occurred, the product of the positive-side maximum second-order differential corresponding value and the negative-side maximum second-order differential corresponding value becomes equal to or smaller than the "predetermined negative threshold value." Therefore, according to the configuration described above, a generation of the air-fuel ratio imbalance state among cylinders can be more certainly determined based on a simple technique.

It should be noted that, "determining that the air-fuel ratio imbalance state among cylinders is occurring when the product of the positive-side maximum second-order differential corresponding value and the negative-side maximum second-order differential corresponding value is smaller than or equal to the predetermined negative value" includes determining that the air-fuel ratio imbalance state among cylinders is occurring when a "product of the positive-side maximum second-order corresponding value (its absolute value) and an absolute value of the negative-side maximum second-order corresponding value" is equal to or larger than a "predetermined positive threshold value obtained by inverting the sign of the negative threshold value."

Further, any of the imbalance determining means may be configured so as to:

obtain the second-order differential values of the detected air-fuel ratio with respect to time obtained every elapse of a predetermined time period within the unit combustion cycle period;

identify a time point when a "positive-side maximum air-fuel ratio second-order differential value whose absolute value is maximum (largest)" emerges (is found) out of "air-fuel ratio second-order differential values having positive values" among a plurality of the air-fuel ratio second-order differential values obtained within the unit combustion cycle period; and determine "which air-fuel ratio of a cylinder of the at least two cylinders is abnormal" based on the identified time point when it is determined that the air-fuel ratio imbalance state among cylinders is occurring.

Similarly, any of the imbalance determining means may be configured so as to:

obtain the second-order differential values of the detected air-fuel ratio with respect to time obtained every elapse of a predetermined time period within the unit combustion cycle period;

identify a time point when a "negative-side maximum air-fuel ratio second-order differential value whose absolute value is maximum (largest)" emerges (is found) out of "air-fuel ratio second-order differential values having negative values" among a plurality of the air-fuel ratio second-order differential values obtained within the unit combustion cycle period; and determine "which air-fuel ratio of a cylinder of the at least two cylinders is abnormal" based on the identified time point when it is determined that the air-fuel ratio imbalance state among cylinders is occurring.

If the time point when the above-mentioned positive-side maximum second-order differential value emerged or a time point when the above-mentioned negative-side maximum second-order differential value emerged is identified, it is possible to determine which cylinder causes the air-fuel ratio imbalance state among cylinders (i.e., which cylinder is a cylinder to which an air-fuel mixture whose air-fuel ratio greatly deviates from the stoichiometric air-fuel ratio is supplied) based on a crank angle difference between a "reference crank angle of a identified cylinder of the engine (for example, a compression top dead center of that specific cylinder)" and the "crank angle corresponding to that identified time point".

Meantime, the air-fuel ratio imbalance state among cylinders is classified into a "state (rich-shift imbalance state) where only an air-fuel ratio of a certain cylinder (for example, the first cylinder) greatly deviates from the stoichiometric air-fuel ratio to a richer side" and a "state (lean-shift imbalance state) where only an air-fuel ratio of a certain cylinder greatly deviates from the stoichiometric air-fuel ratio to a leaner side."

Further, according to the experiments, as shown in (B) of FIG. 17, when the "rich-shift imbalance state" has occurred, an absolute value (magnitude of an inclination (slope) $\alpha$1) of a change rate of the detected air-fuel ratio (i.e., a time differential value of the detected air-fuel ratio) while the detected air-fuel ratio is increasing is smaller than an absolute value (magnitude of an inclination (slope) $\alpha$2) of a change rate of the detected air-fuel ratio while the detected air-fuel ratio is decreasing. Therefore, the detected air-fuel ratio is relatively-rapidly decreases after the detected air-fuel ratio relatively-moderately increases.

Therefore, as shown in (C) of FIG. 17, a time point (first time point t1) when the "positive-side maximum second-order differential value whose absolute value is largest" out of second-order differential values having positive values among a plurality of second-order differential values obtained within one unit combustion cycle period emerges occurs immediately after a time point (second time point t2) when the "negative-side maximum second-order differential value whose absolute value is largest" out of second-order differential values having negative values among a plurality of the second-order differential values obtained within that unit combustion cycle period emerges.

Contrary to this, as shown in (D) of FIG. 17, when the "lean-shift imbalance state" has occurred, an absolute value (magnitude of an inclination (slope) $\alpha$3) of a change rate of the detected air-fuel ratio while the detected air-fuel ratio is increasing is larger than an absolute value (magnitude of an inclination (slope) $\alpha$4) of a change rate of the detected air-fuel ratio while the detected air-fuel ratio is decreasing. Therefore, the detected air-fuel ratio is relatively-moderately decreases after the detected air-fuel ratio relatively-rapidly increases.

Therefore, as shown in (E) of FIG. 17, a time point (second time point t2) when the "negative-side maximum second-order differential value whose absolute value is largest" out of second-order differential values having negative values among a plurality of second-order differential values obtained within one unit combustion cycle period emerges occurs immediately after a time point (first time point t1) when the "positive-side maximum second-order differential value whose absolute value is largest" out of second-order differential values having positive values among a plurality of the second-order differential values obtained within that unit combustion cycle period emerges.

According to such facts, when a time period from a "time point when the positive-side maximum second-order differential value emerges (is found)" to a "time point when the negative-side maximum second-order differential value subsequent to that positive-side maximum second-order differential value emerges (is found)" is defined as a first time period T1, and when a time period from a "time point when the negative-side maximum second-order differential value emerges (is found)" to a "time point when the positive-side maximum second-order differential value subsequent to that negative-side maximum second-order differential value emerges (is found)" is defined as a second time period T2, a relationship described below is established.

(1) When the "rich-shift imbalance state" has occurred, the first time period T1 becomes longer than the second time period T2 (refer to (C) of FIG. 17).

(2) When the "lean-shift imbalance state" has occurred, the first time period T1 is shorter than the second time period T2 (refer to (E) of FIG. 17).

In view of the above, any of the imbalance determining means may be configured so as to obtain the first time period and the second time period, so as to identify (determine) whether the "rich-shift imbalance state" is occurring or the "lean-shift imbalance state" is occurring based on a magnitude relation between the first time period and the second time period when it is determined that the air-fuel ratio imbalance state among cylinders is occurring.

The second-order differential value of the detected air-fuel ratio represented by the air-fuel ratio sensor output can be obtained as described below.

The air-fuel sensor output is obtained every time a constant sampling time period elapses. The constant sampling time period may be a time period obtained through dividing the predetermined time period by a natural number.

A value is obtained as a "detected air-fuel ratio change rate", the value being obtained by subtracting a "previously-detected air-fuel ratio" represented by the "air-fuel ratio sensor output obtained at a time point the sampling time period before the current time point"

from a "currently-detected air-fuel ratio" represented by the "newly-obtained air-fuel ratio sensor output."

A value is obtained as the "second-order differential value", the value being obtained by subtracting a "previously-detected air-fuel ratio change rate obtained at the time point the sampling time period before the current time point" from a "newly-obtained currently-detected air-fuel ratio change rate."

Alternatively, the second-order differential value of the detected air-fuel ratio represented by the air-fuel ratio sensor output can be obtained as described below.

The air-fuel sensor output is obtained every time a constant sampling time period elapses.

A value is obtained as a "detected air-fuel ratio change rate", the value being obtained by subtracting a "previously-detected air-fuel ratio represented by the air-fuel ratio sensor output obtained at a time point the sampling time period before the current time point" from a "currently-detected air-fuel ratio represented by the newly-obtained air-fuel ratio sensor output."

A value is obtained as an increasing-side detected air-fuel ratio change rate average value, the value being an "average value of the detected air-fuel ratio change rates having positive values" among a plurality of the detected air-fuel ratio change rates obtained within the unit combustion cycle period.

A value is obtained as a decreasing-side detected air-fuel ratio change rate average value, the value being an "average value of the detected air-fuel ratio change rates having negative values" among a plurality of the detected air-fuel ratio change rates obtained within the unit combustion cycle period.

A difference between the increasing-side detected air-fuel ratio change rate average value and the decreasing-side detected air-fuel ratio change rate average value is obtained as the "second-order differential value."

According to this configuration, the "average value of the change rates of detected air-fuel ratios having positive values" and the "average value of change rates of detected air-fuel ratios having negative values" are obtained within one unit combustion cycle period, and the second-order differential value is obtained based upon those values. Therefore, even when noises are superposed onto the air-fuel ratio sensor output, the affect of such noises to the second-order differential values can be reduced. Therefore, the air-fuel ratio imbalance among cylinders determination can be more surely carried out.

BRIEF DESCRIPTION OF THE DRAWINGS

FIG. 1 is a chart showing the behaviors of changes of a detected air-fuel ratio obtained based on an output of an air-fuel ratio sensor, a locus (trajectory) length of the detected air-fuel ratio, and a second-order differential value of the detected air-fuel ratio, and the like;

EMBODIMENT FOR CARRYING OUT THE INVENTION

First Embodiment

An air-fuel ratio imbalance determining apparatus among cylinders (hereinafter, simply referred to as a "first determining apparatus") according to a first embodiment of the present invention will be described with reference to the drawings. The first determining apparatus is a part of an air-fuel ratio control apparatus for controlling an air-fuel ratio of an internal combustion engine, and also, a fuel injection amount control apparatus for controlling a fuel injection amount.

(Structure)

Figure 2:
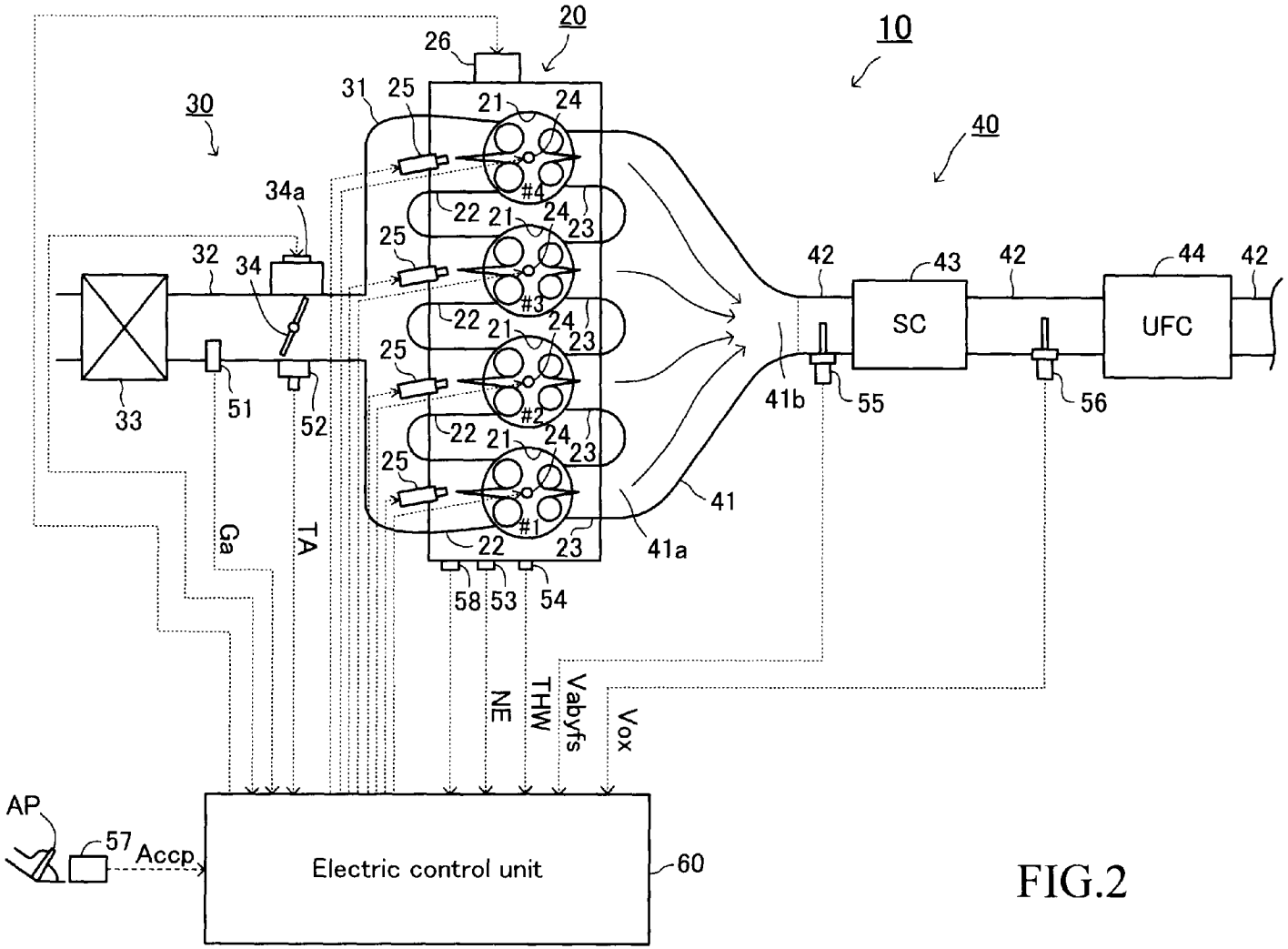
FIG. 2 is a schematic diagram of an internal combustion engine to which an air-fuel ratio imbalance among cylinders determining apparatus (a first determining apparatus) according to a first embodiment of the present invention is applied.

FIG. 2 shows a schematic configuration of an internal combustion engine 10 to which the first determining apparatus is applied. The engine 10 is a four-cycle/spark-ignition type/multi-cylinder (in this case, four-cylinder) gasoline engine. The engine 10 comprises an main body section 20, an intake air system 30, and an exhaust gas system 40.

The main body section 20 includes a cylinder block section and a cylinder head section. The main body section 20 is provided with a plurality (four) of combustion chambers (first cylinder #1 to fourth cylinder #4) 21, each formed by a top surface of a piston, a wall surface of a cylinder, and a lower surface of the cylinder head section.

In the cylinder head section, intake ports 22, each of which is for supplying "mixture including an air and a fuel" to each of combustion chambers (each of the cylinders) 21, and exhaust ports 23, each of which is for discharging exhaust gas (burnt gas) from each of the combustion chambers 21. The intake ports 22 are opened and closed by unillustrated intake valves, and the exhaust ports 23 are opened and closed by unillustrated exhaust valves.

A plurality (four) of spark plugs 24 are fixed at the cylinder head section. Each of the spark plugs 24 is disposed in such a manner that its spark generating section is exposed at a center of each of the combustion chambers 21 and in the vicinity of the lower surface of the cylinder head section. Each of the spark plugs 24 is configured so as to generate an ignition spark from its spark generation section in response to an ignition signal.

Further, a plurality (four) of fuel injection valves (injectors) 25 are fixed at the cylinder head section. Each of the fuel injectors 25 is provided for each of the intake ports 22 one by one. Each of the fuel injectors 25 responds to an injection instruction signal to inject a fuel whose amount is equal to an "instructed injection amount included in the injection instruction signal" into its corresponding intake port 22, when the injector is normal. In this manner, each of a plurality of the cylinders 21 is provided with one fuel injector 25 which supplies the fuel independently from the other cylinders.

Further, an intake valve control unit 26 is provided at the cylinder head section. The intake valve control unit 26 comprises a well known structure for hydraulically adjusting and controlling a relative angle (phase angle) between an intake cam shaft (not shown) and intake cams (not shown). The intake valve control unit 26 is configured so as to change opening timings of the intake valves (intake valve opening timings) in response to an instruction signal (drive signal).

The intake system 30 comprises an intake manifold 31, an intake pipe 32, an air filter 33, a throttle valve 34*a*, and a throttle actuator 34*a*.

The intake manifold 31 comprises a plurality of branch portions, each of which is connected to each of the intake ports 22; and a surge tank section where (to which) the branch portions are aggregated. The intake pipe 32 is connected to the surge tank section. The intake manifold 31, the intake pipe 32, and the plurality of intake ports 22 constitute an intake air passage. An air filter is disposed at an edge portion of the intake pipe 32. The throttle valve 34 is rotatably supported in the intake pipe 32 between the air filter 33 and the intake manifold 31. The throttle valve 34 is rotated to change the opening cross-section area of the intake air passage formed by the intake pipe 32. A throttle valve actuator 34*a* includes a DC motor, and rotates the throttle valve 34 in response to an instruction signal (drive signal).

The exhaust system 40 comprises an exhaust manifold 41, an exhaust pipe (exhaust gas pipe) 42, an upstream catalyst 43, and a downstream catalyst 44.

The exhaust manifold 41 is formed by a plurality of branch portions 41*a*, each of which is connected with each of the exhaust ports 23, and an aggregated portion (exhaust gas aggregated portion) 41*b* where (onto which) these branch portions 41*a* are aggregated. The exhaust pipe 42 is connected to the aggregated portion 41*b* of the exhaust manifold 41. The exhaust manifold 41, the exhaust pipe 42, and a plurality of the exhaust ports 23 constitute a passage through which the exhaust gas passes. It should be noted that, in the present specification, the aggregated portion 41*b* of the exhaust manifold 41 and the exhaust pipe 42 are referred to as an "exhaust passage", for convenience.

The upstream catalyst 43 is a three-way catalyst which supports "noble metals which are catalytic substances" and "ceria($CeO_2$)" on a support made of ceramic to have an oxygen storage and oxygen release functions (oxygen storage function). The upstream catalyst 43 is disposed (interposed) in the exhaust pipe 42. When the temperature of the upstream catalyst 43 reaches a predetermined active temperature, it exhibits a "catalyst function for purify unburnt components (such as HC, CO and $H_2$, and so on) and nitrogen oxide (NOx) simultaneously", and the "oxygen storage function."

The downstream catalyst 44 is a three-way catalyst similar to the upstream catalyst 43. The downstream catalyst 44 is disposed (interposed) in the exhaust pipe 42 and downstream of the upstream catalyst 43. Note that the upstream catalyst 43 and the downstream catalyst 44 may be catalysts other than the three-way catalysts.

The first determining apparatus comprises a hot wire type air-flow meter 51, a throttle position sensor 52, a crank angle sensor 53, an intake cam position sensor 54, an upstream air-fuel ratio sensor 55, a downstream air-fuel ratio sensor 56, an accelerator opening sensor 57, and a water temperature sensor 58.

The hot wire type air-flow meter 51 is configured to detect a mass flow rate of an intake air flowing through the intake pipe 32 to output a signal representing the mass flow rate (an intake air amount per unit time introduced into the engine 10) Ga.

The throttle position sensor 52 is configured to detect an opening (throttle opening) of the throttle valve 34 to output a signal representing a throttle opening TA.

A crank angle sensor (a crank position sensor) 53 is configured so as to generate a signal having a narrow-width pulse at every rotation of 10° of a crank shaft of the engine 10 and a wide-width pulse at every rotation of 360° of the crank shaft. This signal is converted by an electric control unit 60 described later into an engine rotational speed NE.

An intake cam position sensor 54 is configured so as to output one pulse every time an intake camshaft rotates 90°, then another 90°, and further 180° from a predetermined angle. The electric control unit 60 obtains, based on the signals from the crank angle sensor 53 and the intake cam position sensor 54, a crank angle (an absolute crank angle) CA with respect to a reference which is a compression top dead center of a reference cylinder (for example, the first cylinder #1). This crank angle CA is set to (at) "0° crank angle" at the compression top dead center of the reference cylinder, and is increased up to "720° crank angle" in accordance with the rotational angle of the crank shaft, and then is again set to 0° crank angle.

The upstream air-fuel ratio sensor 55 (the air-fuel ratio sensor 55 in the present invention) is disposed in either the exhaust manifold 41 or the exhaust pipe 42, at a position between the aggregated portion 41*b* of the exhaust manifold 41 and the upstream catalyst 43 (i.e., in the exhaust passage). The upstream air-fuel ratio sensor 55 is a "wide range air-fuel ratio sensor of a limiting current type having a diffusion resistance region" disclosed in Japanese Patent Application Laid-Open (Kokai) No. Hei 11-72473, Japanese Patent Application Laid-Open (Kokai) No. 2000-65782, and Japanese Patent Application Laid-Open (Kokai) No. 2004-69547, and so on.

Figure 3:
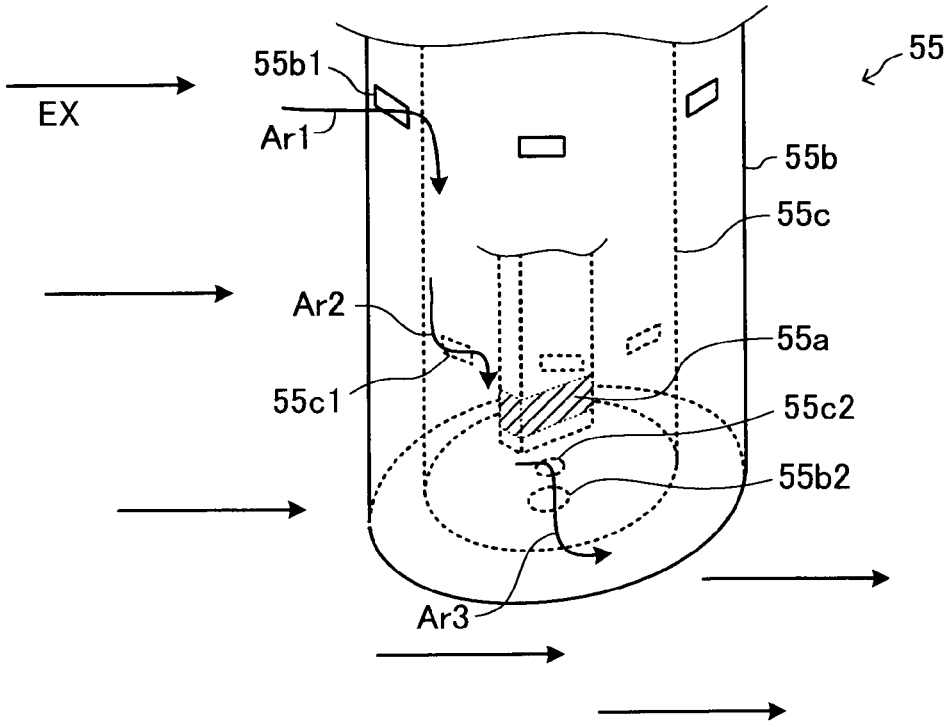
FIG. 3 is a partial schematic perspective view of the air-fuel ratio sensor (upstream air-fuel ratio sensor) shown in FIG. 2.
Figure 4:
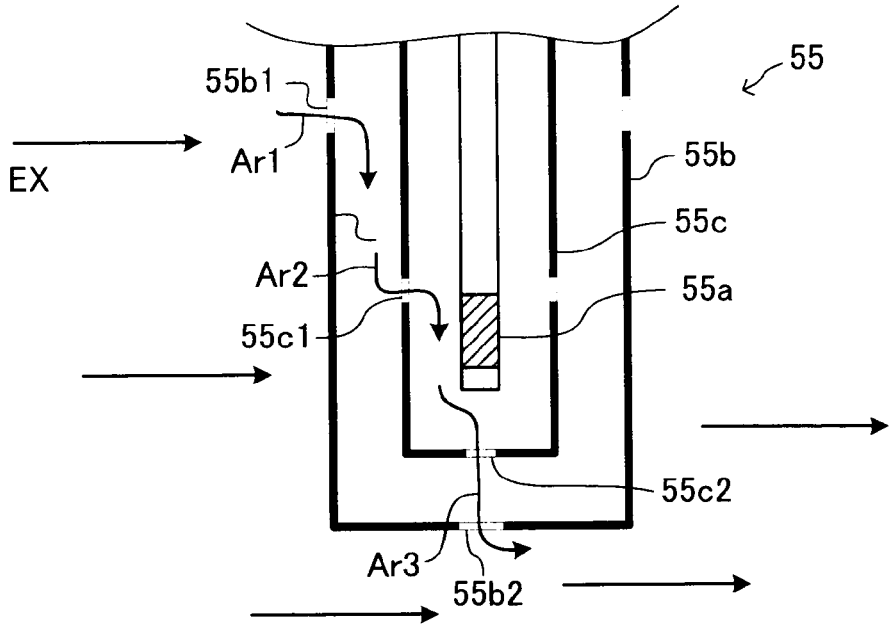
FIG. 4 is a partial cross-sectional view of the air-fuel ratio sensor shown in FIG. 2.

As shown in FIGS. 3 and 4, the upstream air-fuel ratio sensor 55 has an air-fuel ratio detection element 55*a*, an outer protection cover 55*b*, and an inner protection cover 55*c*.

The outer protection cover 55*b* is a hollow cylinder made of a metal. The outer protection cover 55*b* accommodates the inner protection cover 55*c* therein to cover the inner protection cover 55*c*. The outer protection cover 55*b* is provided with a plurality of influent (inflow) holes 55*b*1 on its side surface. The influent holes 55*b*1 are through-holes (penetration holes) for causing exhaust gas flowing in the exhaust gas passage (exhaust gas outside of the outer protection cover 55*b*) EX to flow into an interior of the outer protection cover 55*b*. Further, the outer protection cover 55*b* has an effluent (outflow) hole 55*b*2 on its bottom surface for causing the exhaust gas inside of the outer protection cover 55*b* to flow out to the outside (the exhaust gas passage).

The inner protection cover 55*c* is made of a metal, and is a hollow cylinder having a diameter smaller than that of the outer protection cover 55*b*. The inner protection cover 55*c* accommodates the air-fuel ratio detection element 55*a* therein so as to cover the air-fuel ratio detection element 55*a*. The inner protection cover 55*c* is provided with a plurality influent (inflow) holes 55*c*1 on its side surface. The influent holes 55*c*1 are through-holes (penetration holes) for causing the exhaust gas which has flowed into a "space between the outer protection cover 55*b* and the inner protection cover 55*c*" through the influent holes 55*b*1 of the outer protection cover 55*b* to flow into the inside of the inner protection cover 55*c*. Further, the inner protection cover 55*c* has an effluent hole (outflow hole) 55*c*2 on its bottom surface for causing the exhaust gas within the inner protection cover 55*c* to flow out to the outside.

Figure 5:
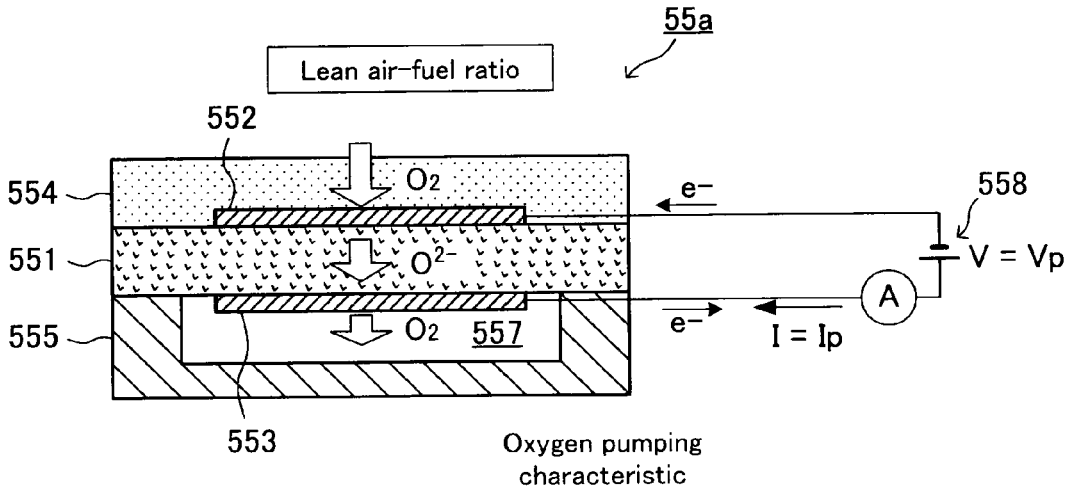
FIG. 5 is a cross-sectional view of an air-fuel ratio detecting element included in the air-fuel ratio sensor shown in FIG. 2.

As shown in FIG. 5, the air-fuel ratio detection element 55*a* includes a solid electrolyte layer 551, an exhaust-gas-side electrode layer 552, an atmosphere-side electrode layer 553, a diffusion resistance layer 554, and a wall section 555.

The solid electrolyte layer 551 is an oxide sintered body having an oxygen ion conductivity. In this example, the solid electrolyte layer 551 is a "stabilized zirconia element" in which CaO is solid-solved as a stabilizing agent into $ZrO_2$ (zirconia). The solid electrolyte layer 551 exhibits a well-known an "oxygen cell characteristic" and an "oxygen pumping characteristic", when its temperature is equal to or higher than an activation temperature.

The exhaust-gas-side electrode layer 552 is made of a precious metal such as platinum (Pt) having a high catalytic activity. The exhaust-gas-side electrode 552 is formed on one of surfaces of the solid electrolytic layer 551. The exhaust-gas-side electrode layer 552 is made by a chemical plating process or the like to have a sufficient permeability (i.e., it is porous).

The atmosphere-side electrode layer 553 is made of a precious metal such as platinum (Pt) having a high catalytic activity. The atmosphere-side electrode 553 is formed on the other one of the surfaces of the solid electrolytic layer 551 so as to oppose the exhaust-gas-side electrode layer 552, thus sandwiching the solid electrolyte layer 551 therebetween. The atmosphere electrode layer 553 is made by a chemical plating process or the like to have a sufficient permeability (i.e., it is porous).

The diffusion resistance layer (diffusion limiting layer) 554 is made of a porous ceramic (heat resistance inorganic substance). The diffusion resistance layer 554 is formed by, for example, a plasma spraying process or the like, so as to cover the outer surface of the exhaust-gas-side electrode layer 552.

The wall section 555 is made of a dense alumina ceramic through which gas can not pass. The wall section 555 is configured to form an "atmosphere chamber 557" which is a space accommodating the atmosphere-side electrode layer 553. An atmosphere is introduced into the atmosphere chamber 557.

The upstream air-fuel ratio sensor 55 is connected to a power supply 558. The power supply 558 applies a voltage V in such a manner that the atmosphere electrode layer 553 has a high potential, and the exhaust-gas-side layer has a low potential.

Figure 6:
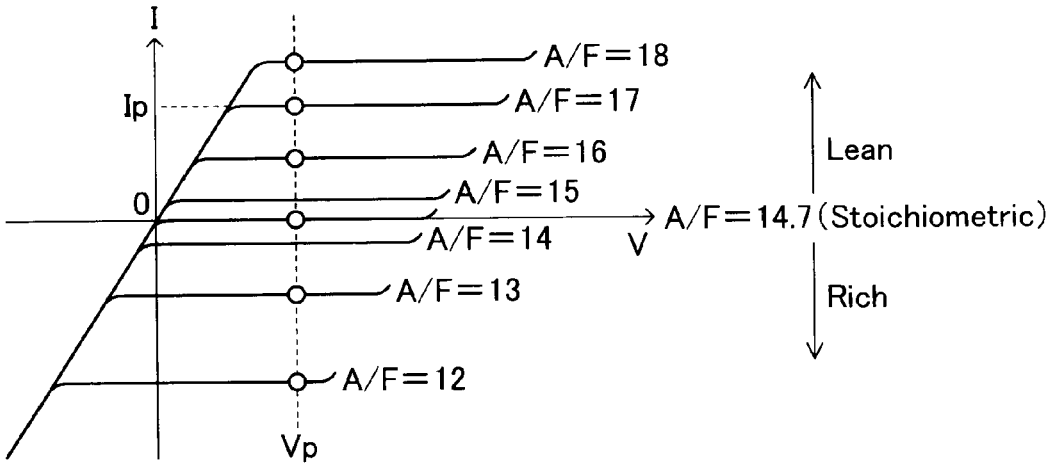
FIG. 6 is a graph showing a relationship between an air-fuel ratio of an exhaust gas and a limiting current value of the air-fuel ratio sensor.

When the air-fuel ratio of the exhaust gas is leaner with respect to the stoichiometric air-fuel ratio, the thus configured upstream air-fuel ratio sensor 55 changes oxygen which has reached the exhaust-gas-side electrode layer 552 through the diffusion resistance layer 554 into oxygen ion to cause the oxygen to pass to the atmosphere electrode layer 553. As a result, a current I flows from the positive electrode of the power supply 558 to the negative electrode of the power supply 558. The magnitude of the current I becomes a constant value in proportion to the concentration of oxygen (the partial pressure of oxygen, the air-fuel ratio of the exhaust gas) which has reached the exhaust-gas-side electrode layer 552, when the voltage V is set to (at) a value equal to or larger than a predetermined value $V_p$, as shown in FIG. 6. The upstream air-fuel ratio sensor 55 converts this current (i.e., the limiting current Ip) into a voltage to output the converted voltage as an output value Vabyfs.

Contrary to this, when the air-fuel ratio of the exhaust gas is richer with respect to the stoichiometric air-fuel ratio, the upstream air-fuel ratio sensor 55 changes oxygen existing in the atmosphere chamber 557 into oxygen ion to cause the oxygen move to the exhaust-gas-side electrode layer 552, and oxidizes unburnt substances (HC, CO and $H_2$, and so on) reaching the exhaust-gas-side electrode layer 552 after passing through the diffusion resistance layer 554. As a result, a current I flows from the negative electrode of the power supply 558 to the positive electrode of the power supply 558. The magnitude of the current I becomes a constant value in proportion to the concentration of unburnt substances (i.e., the air-fuel ratio of the exhaust gas) which has reached the exhaust-gas-side electrode layer 552, when the voltage V is set to (at) a value equal to or higher than a predetermined value $V_p$, as shown in FIG. 6. The upstream air-fuel ratio sensor 55 converts this current (i.e., the limiting current Ip) into a voltage to output the converted voltage as the output value Vabyfs.

Figure 7:
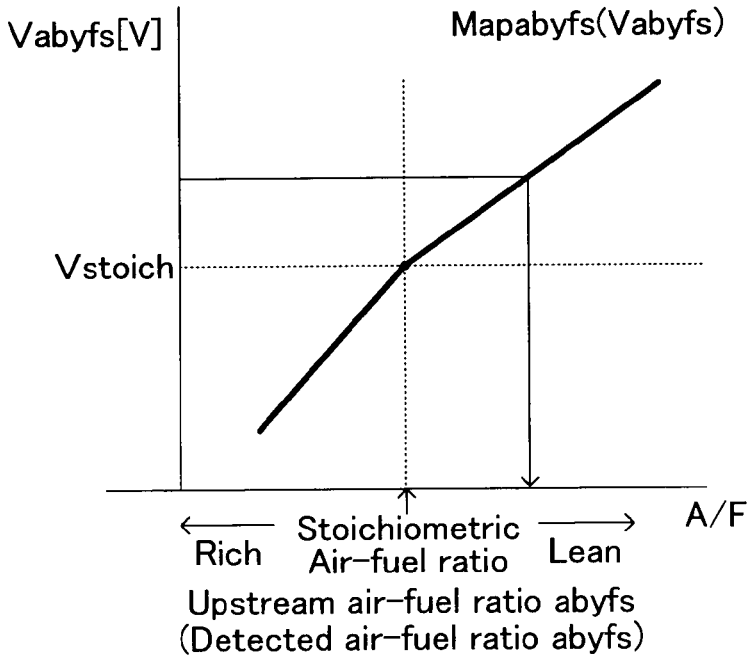
FIG. 7 is a graph showing the relationship between the air-fuel ratio of exhaust gas and the output of the air-fuel ratio sensor.

That is, as shown in FIG. 7, the air-fuel ratio detection element 55*a* outputs, as the "air-fuel ratio sensor output Vabyfs", the output value Vabyfs varying depending on (in accordance with) the air-fuel ratio of the gas (an upstream air-fuel ratio abyfs, a detected air-fuel ratio abyfs) which has reached the air-fuel ratio detection element 55*a* after passing through the influent holes 55*b*1 of the outer protection cover 55*b* and the influent holes 55*c*1 of the inner protection cover 55*c* while flowing at a disposed location of the air-fuel ratio sensor 55. The air-fuel ratio sensor output Vabyfs increases (becomes larger) as the air-fuel ratio of the gas reaching the air-fuel ratio detection element 55*a* becomes larger (leaner). That is, the air-fuel ratio sensor output Vabyfs is substantially in proportion to the air-fuel ratio of the exhaust gas reaching the air-fuel ratio detection element 55*a*.

An electric control unit 60 described later stores an air-fuel ratio conversion table (map) Mapabyfs shown in FIG. 7, and applies the air-fuel ratio sensor output Vabyfs to the air-fuel ratio conversion table Mapabyfs (Vabyfs) to detect an actual upstream air-fuel ratio abyfs (i.e., to obtain the detected air-fuel ratio abyfs).

Incidentally, the upstream air-fuel ratio sensor 55 is disposed between the aggregated portion 41*b* of the exhaust manifold 41 and the upstream catalyst 43 in such a manner that the outer protection cover 55*b* is exposed in either the exhaust manifold 41 or the exhaust pipe 42. At this time, the center axis of the outer protection cover 55*b* is perpendicular to the direction of flow of the exhaust gas, and the bottom surface of the outer protection cover 55*b* is in parallel with the direction of flow of the exhaust gas.

Therefore, as shown in FIGS. 3 and 4, exhaust gas EX flowing through the exhaust gas passage passes through the influent holes 55*b*1 of the outer protection cover 55*b* to flow into the "space between the outer protection cover 55*b* and the inner protection cover 55*c*" (refer to an arrow Ar1). Subsequently, as indicated by an arrow A2, that exhaust gas passes through the influent holes 55*c*1 of the inner protection cover 55*c* to flow into the "inside of the inner protection cover 55*c*", and reaches the air-fuel ratio detection element 55*a*. Thereafter, as indicated by an arrow Ar3, that exhaust gas passes through "the effluent hole 55*c*2 of the inner protection cover 55*c* and the effluent hole 55*b*2 of the outer protection cover 55*b*" to flow out to the exhaust gas passage. That is, the exhaust gas EX which has reached the influent holes 55*b*1 of the outer protection cover 55*b* is sucked into the inside of the outer protection cover 55*b* and the inner protection cover 55*c* by the flow of the exhaust gas EX in the vicinity of the effluent hole 55*b*2 of the outer protection cover 55*b* within the exhaust gas passage.

Therefore, the flow rate of the exhaust gas within the outer protection cover 55*b* and the inner protection cover 55*c* varies depending on (in accordance with) the flow rate of the exhaust gas EX flowing in the vicinity of the effluent hole 55*b*2 of the outer protection cover 55*b* (and accordingly, depending on the intake air-flow rate Ga which is the intake air amount per unit time). In other words, a time period from a "time point when an exhaust gas (first exhaust gas) having a certain air-fuel ratio has reached the influent holes 55*b*1" to a "time point when that first exhaust gas reaches the air-fuel ratio detection element 55*a*" depends on the intake air-fuel rate Ga, but does not depend on the engine rotational speed NE. This is applied to a case where the upstream air-fuel ratio sensor 55 has only the inner protection cover.

As a result, for example, when the air-fuel ratio imbalance state among cylinders has occurred, and thus, the exhaust gas greatly deviating from the stoichiometric air-fuel ratio to a richer side begins to reach the influent holes 55*b*1 at a certain time point, that exhaust gas will reach the air-fuel ratio detection element 55*a* a little later from that time point. As explained above, the flow rate of the exhaust gas flowing in the inside of the outer protection cover 55*b* and the inner protection cover 55*c* is determined by the flow rate of the exhaust gas flowing through the exhaust gas passage.

Further, the air-fuel ratio of the exhaust gas contacting with the air-fuel ratio detection element 55*a* is an air-fuel ratio of exhaust gas formed by mixing "the exhaust gas newly reaching the air-fuel ratio detection element 55*a*" and "the exhaust gas already present in the vicinity of the air-fuel ratio detection element 55*a*." Therefore, a change rate of the air-fuel ratio of the exhaust gas in contact with (reaching) the air-fuel ratio detection element 55*a* (the change rate being a time differential value of the air-fuel ratio, and therefore, being a differential value of the detected air-fuel ratio abyfs with respect to time, a detected air-fuel ratio change rate, an inclination (slope) of a change of the detected air-fuel ratio) becomes larger (increases), as the "intake air flow rate Ga substantially in proportion to the flow rate of the exhaust gas EX" becomes larger. That is, the air-fuel ratio of the exhaust gas in contact with (reaching) the air-fuel ratio detection element 55*a* rapidly decreases as the intake air flow rate Ga is larger.

Thereafter, an exhaust gas whose air-fuel ratio does not greatly deviated from the stoichiometric air-fuel ratio begins to reach the influent holes 55*b*1 at a certain time point. That exhaust gas will reach the air-fuel ratio detection element 55*a* a little later from that time point. However, in this case as well, as described above, the flow rate of the exhaust gas flowing through the inside of the outer protection cover 55*b* and the inner protection cover 55*c* is determined by the flow rate of the exhaust gas EX flowing through the exhaust gas passage. Therefore, the air-fuel ratio of the exhaust gas in contact with (reaching) the air-fuel ratio detection element 55*a* rapidly increases as the intake air-fuel ratio Ga is larger.

On the one hand, a time interval (i.e., a period of fluctuation of the air-fuel ratio) becomes shorter, the time interval being between time points at which the exhaust gas greatly deviating from the stoichiometric air-fuel ratio to a richer side starts to reach the influent holes 55*b*1, as the engine rotational speed NE becomes larger. As explained above, however, the flow rate of the exhaust gas flowing through the inside of the outer protection cover 55*b* and the inner protection cover 55*c* is determined by the flow rate of the exhaust gas flowing through the exhaust gas passage, but is not affected by the engine rotational speed NE. Therefore, unless the intake air-fuel rate Ga is changed, the change rate of the detected air-fuel ratio abyfs (refer to the inclinations $\alpha$1, $\alpha$2 of (B) in FIG. 1) does not change.

Referring back to FIG. 2 again, the downstream air-fuel ratio sensor 56 is disposed in the exhaust pipe 42 (that is, in the exhaust gas passage) at a position between the upstream catalyst 43 and the downstream catalyst 44). The downstream air-fuel ratio sensor 56 is a well-known concentration-cell-type oxygen concentration sensor ($O_2$ sensor). The downstream air-fuel ratio sensor 57 is configured so as to generate an output value Voxs corresponding to an air-fuel ratio (downstream air-fuel ratio afdown) of exhaust gas which passes through a position where the downstream air-fuel ratio sensor 56 is disposed.

Figure 8:
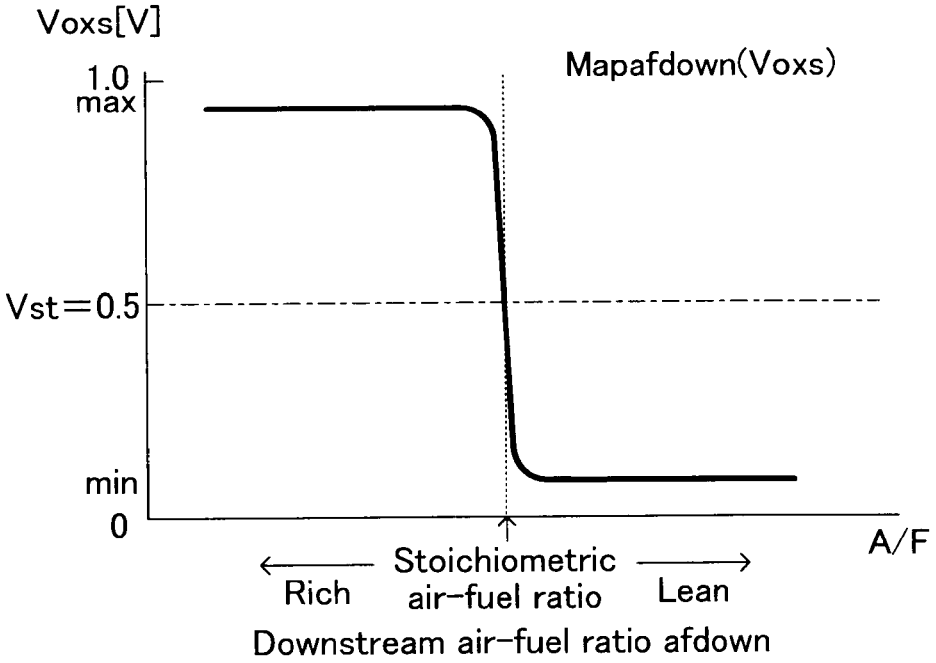
FIG. 8 is a graph showing a relationship between an air-fuel ratio of exhaust gas and an output of the downstream air-fuel ratio sensor shown in FIG. 2.

As shown in FIG. 8, when the air-fuel ratio of a gas to be detected is richer with respect to the stoichiometric air-fuel ratio, the output value Voxs of the downstream air-fuel ratio sensor 56 becomes its maximum output value max (for example, about 0.9V). When the air-fuel ratio of the gas to be detected is leaner with respect to the stoichiometric air-fuel ratio, the output value Voxs becomes its minimum output value min (for example, about 0.1V). Further, when the air-fuel ratio of the detected gas is equal to the stoichiometric air-fuel ratio, the output value Vox coincides with a value roughly equal to an intermediate voltage Vst (middle voltage Vst, for example, about 0.5V) between the maximum output value max and the minimum output value min. When the air-fuel ratio of the gas to be detected changes from a richer air-fuel ratio to a leaner air-fuel ratio with respect to the stoichiometric air-fuel ratio, the output value Voxs rapidly varies from the maximum output value max to the minimum output value min. Similarly, when the air-fuel ratio of the gas to be detected changes from a leaner air-fuel ratio to a richer air-fuel ratio with respect to the stoichiometric air-fuel ratio, the output value Voxs rapidly varies from the minimum output value max to the maximum output value min.

The accelerator opening sensor 57 shown in FIG. 2 is configured so as to detect an operational amount of an accelerator pedal AP operated by the driver to output a signal representing the operational amount Accp of the accelerator pedal AP.

The water temperature sensor 58 is configured so as to detect a temperature of a coolant of the internal combustion engine 10 to output a signal representing a coolant temperature THW.

The electric control unit 60 is a "well-known microcomputer" which comprises "a CPU, a ROM, a RAM, a backup RAM (or a nonvolatile memory such as an EEPROM, and so on), and an interface including an AD converter and the like."

The backup RAM is configured to receive a power supplied from a battery mounted on a vehicle on which the engine 10 is mounted regardless of a position (an OFF position, a start position, an ON position, or the like) of an unillustrated ignition key switch of the vehicle. When the backup RAM receives the power supplied from the battery, the backup RAM stores data (data is written in the backup RAM) in response to an instruction of the CPU, and maintains (memorizes) that data in such a manner that the data is readable.

The interface of the electric control unit 60 is connected to the above-mentioned switches 51 to 58 to supply signals from these switches 51 to 58 to the CPU. Further, the interface is configured so as to send instruction signals (drive signals) to the spark plug 24 of each of the cylinders, the fuel injector 25 provided for each of the cylinders, the intake value control unit 26, and a throttle valve actuator 34*a*, in accordance with the instructions from the CPU. Note that the electric control unit 60 is configured so as to send the instruction signal to the throttle valve actuator 34*a* in such a manner that the throttle valve opening TA is increased, as the obtained operational amount Accp of the accelerator pedal becomes larger.

(Outline of the Operation)

The first determining apparatus performs the air-fuel ratio imbalance among cylinders determination based on the second-order differential corresponding values, similarly to the other air-fuel ratio imbalance among cylinders determining apparatuses according to the other embodiments described later. The second-order differential corresponding value is a value varying in accordance with (depending on) the "second-order differential value ($d^2$(abyfs)/$dt^2$) with respect to time" of the "detected air-fuel ratio obtained based on the output (output value Vabyfs) of the upstream air-fuel ratio sensor 55."

More specifically, the first determining apparatus carries out the air-fuel ratio imbalance among cylinders determination in accordance with the following procedures.

(First Procedure) The first determining apparatus obtains the output value Vabyfs of the upstream air-fuel ratio sensor 55 every time a constant sampling time period "ts" elapses.

(Second Procedure) The first determining apparatus obtains the detected air-fuel ratio abyfs by applying the output value Vabyfs to the air-fuel ratio conversion table Mapabyfs shown in FIG. 7, every time the constant sampling time period "ts" elapses.

(Third Procedure) The first determining apparatus obtains a current change rate d1AF(n) of the detected air-fuel ratio, by subtracting, from the detected air-fuel ratio abyfs (hereinafter, also referred to as a "currently-detected air-fuel abyfs(n)") at a certain time point when an arbitrary sampling time period ts has elapsed, the detected air-fuel ratio abyfs (hereinafter, also referred to as a "previously-detected air-fuel ratio abyfs(n−1)") at a time point the sampling time period ts before the certain time point. Since the sampling time period "ts" is short, the currently-detected air-fuel ratio change rate d1AF(n) can be said to be a first-order differential value dabyfs/dt with respect to time (a temporal differential value). It should be noted that, hereinafter, a variable affixed by (n) means a current (updated) value, and a variable affixed by (n−m) means a "variable m-times before (i.e., variable a time period of (m·ts) before)."

(Fourth Procedure) The first determining apparatus subtracts, from the currently-detected air-fuel ratio change rate d1AF(n), the previously-detected air-fuel ratio change rate d1AF(n−1) (at the timing the sampling time period "ts" before), so as to calculate a change rate d2AF(n) of the detected air-fuel ratio change rate. Since the sampling time period "ts" is short, the change rate d2AF(n) of the detected air-fuel ratio change rate can be said to be a second-order differential value $d^2$(abyfs)/$dt^2$ of the detected air-fuel ratio abyfs with respect to time.

(Fifth Procedure) The first determining apparatus adopts the second-order differential value d2AF(n) as an air-fuel ratio second-order differential corresponding value HD2AF, and compares the absolute value |HD2AF| of the air-fuel ratio second-order differential corresponding value HD2AF with a first threshold value Th1. When the absolute value |HD2AF| is larger than the first threshold value Th1, the first determining apparatus determines that an air-fuel ratio imbalance state among cylinders has occurred.

It should be noted that the sampling of the output value Vabyfs is carried out every time the sampling time period "ts" elapses, however, it is not necessary for the other calculations to be carried out every time the sampling time period "ts" elapses. That is, the first determining apparatus may obtain and store in the RAM the output values Vabyfs, each of which is obtained at every elapse of sampling time period, until one unit combustion cycle period elapses, for example. Thereafter, when the one unit combustion cycle period has elapsed, the first determining apparatus may obtain, based on a "plurality of the output values Vabyfs stored in the RAM, "the detected air-fuel ratios abyfs, the detected air-fuel ratio change rates d1AF(n), and second-order differential values d2AF(n)" at time points every time sampling time period passed within that one unit combustion cycle period.

The "unit combustion cycle period" is a time period required for an arbitrary one cylinder of a plurality of the cylinders (in this example, all of the cylinders) whose exhaust gases reach the upstream air-fuel ratio sensor 55 to complete one combustion cycle period formed of "an intake stroke, a compression stroke, an expansion stroke, and an exhaust gas stroke". Since the engine 10 is a four-cylinder/four-cycle engine, the unit combustion cycle period is a "time period for the crank angle of the engine to increase by 720°."

(Actual Operation)

An actual operation of the first determining apparatus will next be described.

<Control of Fuel Injection Amount>

The CPU of the electric control unit 60 repeatedly executes a "routine for calculating a fuel injection amount Fi and giving an fuel injection instruction" shown in FIG. 9 every time a crank angle of a certain cylinder coincides with a predetermined crank angle (for example, BTDC 90° CA) before an intake top dead center, for that cylinder (hereinafter, also referred to as a "fuel injection cylinder"). Therefore, at an appropriate time point, the CPU starts a process from step 900 to sequentially carry out processes of steps from step 910 to step 940 described below, and thereafter proceeds to step 995 to end the present routine tentatively.

Step 910: The CPU obtains an "in-cylinder intake air amount Mc(k)" which is an "air amount taken into the fuel injection cylinder" based on an "intake air flow rate Ga measured by the air-flow meter 51, an engine rotational speed NE, and a look-up table MapMc." The in-cylinder intake air amount Mc(k) is stored in the RAM with correlating each of the intake strokes. The in-cylinder intake air amount Mc(k) may be calculated by a well-known air model (a "model constructed in accordance with a law of physics", simulating the behavior of air in the intake air passage).

Step 920: The CPU obtains a base fuel injection amount Fbase by dividing the in-cylinder intake air amount Mc(k) by an upstream target air-fuel ratio abyfr. The upstream target air-fuel ratio abyfr is set to (or at) the stoichiometric air-fuel ratio stoich except for the specific cases.

Step 930: The CPU obtains a final fuel injection amount Fi by correcting the base fuel injection amount Fbase with an air-fuel ratio feedback amount DFi (by adding the air-fuel ratio feedback amount DFi). The calculation method of the air-fuel ratio feedback amount DFi is well known. The air-fuel ratio feedback amount DFi is a correction amount to have the air-fuel ratio of air-fuel mixtures supplied to the engine coincide with the stoichiometric air-fuel ratio. For example, when a predetermined air-fuel ratio feedback condition is satisfied, the air-fuel ratio feedback amount DFi can be obtained as described below. Note that, when the air-fuel ratio feedback condition is not satisfied, the air-fuel ratio feedback amount DFi is set to (or at) "0."

The CPU obtains an output value Vabyfc for the feedback control in accordance with a formula (1) described below. In the formula (1), Vabyfs is the output of the upstream air-fuel ratio sensor 55, and Vafsfb is a sub feedback amount calculated based on the output Voxs of the downstream air-fuel ratio sensor 56. A calculation method of the sub feedback amount Vafsfb will be described later.

$$Vabyfc=Vabyfs+Vafsfb \quad (1)$$

The CPU obtains an air-fuel ratio abyfsc for the feedback control, according to a formula (2) described below, by applying the above-mentioned output value Vabyfc for the feedback control to the air-fuel ratio conversion table Mapabyfs shown in FIG. 7.

$$abyfsc=Mapabyfs(Vabyfc) \quad (2)$$

The CPU calculates an "in-cylinder fuel supply amount error DFc" representing an excess and deficiency in the fuel supplied to the cylinder N-strokes before in accordance with formulas (3) to (5).

An in-cylinder intake air amount Mc(k−N) is an "in-cylinder intake air amount N-cycles before the current time point".

An in-cylinder fuel supply amount Fc(k−N) is an "amount of the fuel actually supplied to the combustion chambers 21 N-cycles before the current time point".

A target in-cylinder fuel supply amount Fcr(k−N) is an "amount of a fuel to be supplied to the combustion chambers 21 N-cycles before the current time point".

$$Fc(k-N)=Mc(k-N)/abyfsc \quad (3)$$

$$Fcr=Mc(k-N)/abyfr \quad (4)$$

$$DFc=Fcr(k-N)-Fc(k-N) \quad (5)$$

The CPU calculates the air-fuel ratio feedback amount DFi according to a formula (6) described below.

Gp is a preset proportional gain.

Gi is a preset integral gain.

SDFc is an "integral value of the in-cylinder fuel supply amount error DFc".

$$DFi=Gp\cdot DFc+Gi\cdot SDFc \quad (6)$$

For example, the CPU calculates the sub feedback amount Vafsfb as described below.

The CPU obtains an "output error amount DVoxs" which is a difference between a "downstream target value Voxsref corresponding to the stoichiometric air-fuel ratio" and the "output Voxs of the downstream air-fuel ratio sensor 56" in accordance with a formula (7) below.

$$DVoxs=Voxsref-Voxs \quad (7)$$

The CPU obtains the sub feedback amount Vafsfb in accordance with a formula (8) below.

Kp is a preset proportional gain (proportional constant).

Ki is a preset integral gain (integral constant).

Kd is a preset differential gain (differential constant).

SDVoxs is a temporal integral value of the output error amount DVoxs.

DDVoxs is a temporal differential value of the output error amount DVoxs.

$$Vafsfb=Kp\cdot DVoxs+Ki\cdot SDVoxs+Kd\cdot DDVoxs \quad (8)$$

That is, the CPU calculates the "sub feedback amount Vafsfb" by a proportional-integral-differential (PID) control to have the output Voxs of the downstream air-fuel ratio sensor 56 coincide with the downstream target value Voxsref. As described in the formula (1) above, the sub feedback amount Vafsfb is used to calculate the output value Vabyfc for the feedback control.

Step 940: The CPU sends an instruction signal to the "fuel injector 25 provided for the fuel injection cylinder" so that a fuel whose amount is equal to the final fuel injection amount (instructed injection amount) Fi is to be injected from that fuel injector 25.

In this manner, the amount of the fuel injected from each of the fuel injectors 25 is uniformly increased and decreased using the air-fuel ratio feedback amount DFi which is common to all of the cylinders.

<Air-Fuel Ratio Imbalance Among Cylinders Determination>

Processes for carrying out the "air-fuel ratio imbalance among cylinders determination" will be described with reference to FIGS. 10 and 11. The CPU is configured to execute a "routine for obtaining the air-fuel ratio second-order differential corresponding value HD2AF" shown by a flowchart of FIG. 10 every time 4 ms (4 m seconds=the predetermined sampling time "ts") elapses.

Therefore, at an appropriate time point, the CPU starts a process at step 1000 to sequentially carry out processes of steps from step 1010 to step 1070 described below, and proceeds to step 1095 to end the present routine tentatively.

Step 1010: The CPU obtains the output Vabyfs (air-fuel ratio sensor output Vabyfs) of the upstream air-fuel ratio sensor 55 at the present time point by performing an A/D conversion.

Step 1020: The CPU obtains the currently-detected air-fuel ratio abyfs(n) by applying the air-fuel ratio sensor output Vabyfs to the air-fuel ratio conversion table Mapabyfs.

Step 1030: The CPU obtains the currently-detected air-fuel ratio change rate d1A1(n) (i.e., first-order differential value of the detected air-fuel ratio abyfs with respect to time) by subtracting the previously-detected air-fuel ratio abyfs(n−1) from the currently-detected air-fuel ratio abyfs(n).

Step 1040: The CPU obtains a change rate d2AF(n) of the detected air-fuel ratio change rate by subtracting the previously-detected air-fuel ratio change rate d1AF(n−1) from the currently-detected air-fuel ratio change rate d1AF(n). Since the change rate d2AF(n) of the detected air-fuel ratio change rate is the differential value of the detected air-fuel ratio change rate d1AF(n) with respect to time, the change rate d2AF(n) is the second-order differential value d2AF(n) of the detected air-fuel ratio abyfs with respect to time.

Step 1050: The CPU stores the currently-detected air-fuel ratio abyfs(n) as the previously-detected air-fuel ratio abyfs (n−1) for the next calculation.

Step 1060: The CPU stores the currently-detected air-fuel ratio change rate d1A1(n) as the previously-detected air-fuel ratio change rate d1AF(n−1) for the next calculation.

Step 1070: The CPU stores the second-order differential value d2AF(n) as the air-fuel ratio second-order differential corresponding value HD2AF.

With the processes described above, the air-fuel ratio second-order differential corresponding value HD2AF every elapse of 4 ms (the sampling time ts) is obtained.

Figure 11:
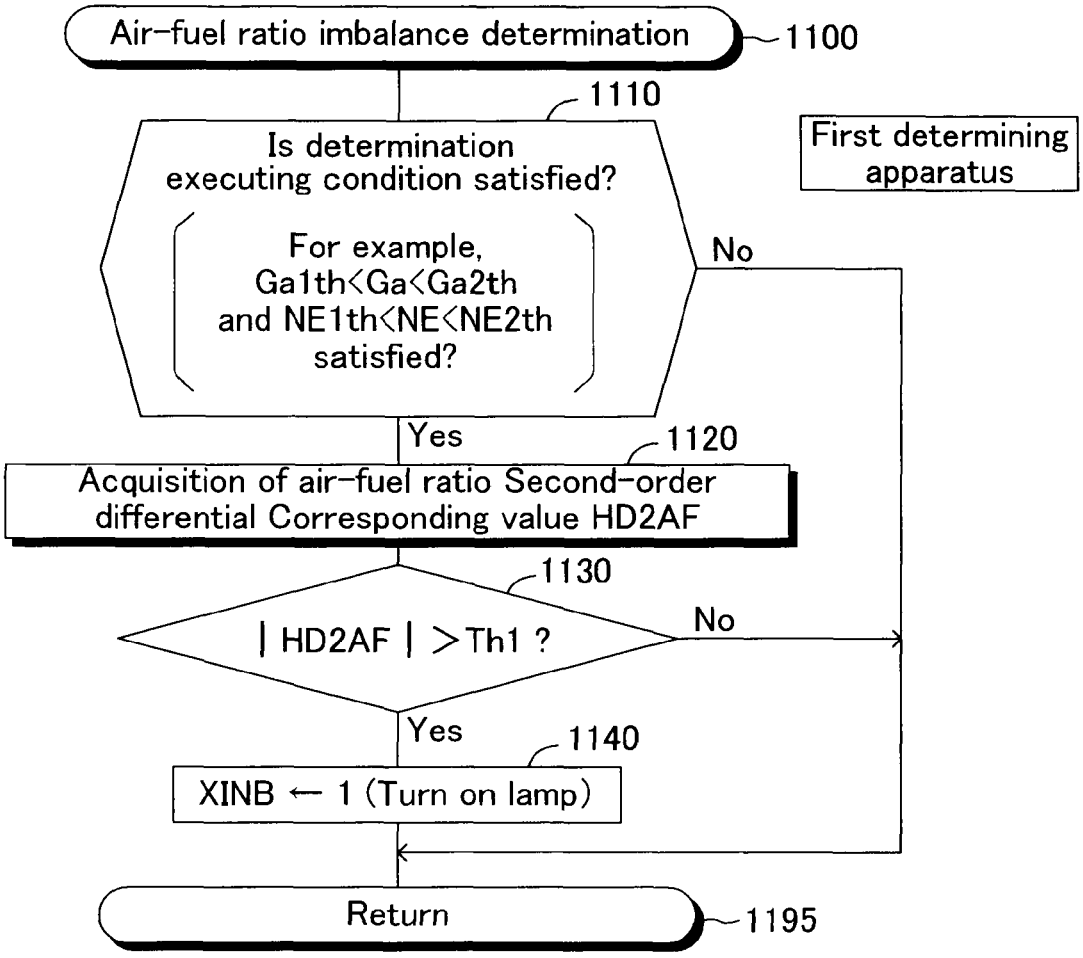
FIG. 11 is a flowchart showing a routine executed by the CPU of the electric control unit shown in FIG. 2.

Further, the CPU is configured to execute an "air-fuel ratio imbalance among cylinders determination routine" shown by a flowchart of FIG. 11 every time the sampling time "ts" (or a predetermined time period which is natural number-times longer than the sampling time period "ts"). Therefore, at an appropriate time point, the CPU starts a process of step 1100 to proceed to step 1110, at which the CPU determines whether or not a condition (a determination execution condition, a determination permitting condition) for carrying out the air-fuel ratio imbalance among cylinders determination is satisfied.

This determination execution condition is satisfied when all of the following conditions A1 to A4 are satisfied. It should be noted that the determination execution condition may be a condition which is satisfied when the conditions A1, A3 and A4 are established. Of course, the determination execution condition may be a condition which is satisfied when other additional conditions are further satisfied.

(Condition A1) The intake air flow rate Ga is larger than a lower-side intake air flow rate threshold value (a first threshold air flow rate) Ga1th and smaller than an upper-side intake air flow rate threshold value (a second threshold air flow rate) Ga2th. Note that the upper-side intake air flow rate threshold value Ga2th is larger than the lower-side intake air flow rate threshold value Ga1th.

(Condition A2) The engine rotational speed NE is larger than a lower-side engine rotational speed threshold value (a first engine rotational speed) NE1th and smaller than an upper-side engine rotational speed threshold value (a second threshold engine rotational speed) NE2th. Note that the upper-side engine rotational speed threshold value NE2th is larger than the lower-side engine rotational speed threshold value NE1th.

(Condition A3) The engine is not in a fuel-cut state.

(Condition A4) The upstream air-fuel ratio sensor 55 is activated, and is not abnormal.

(Condition A5) The air-fuel ratio feedback control is being performed.

When the determination execution condition is not satisfied, the CPU makes a "No" determination at step 1110 to directly proceed to step 1195 to end the present routine tentatively. Therefore, in this case, the air-fuel ratio imbalance among cylinders determination is not carried out.

Figure 10:
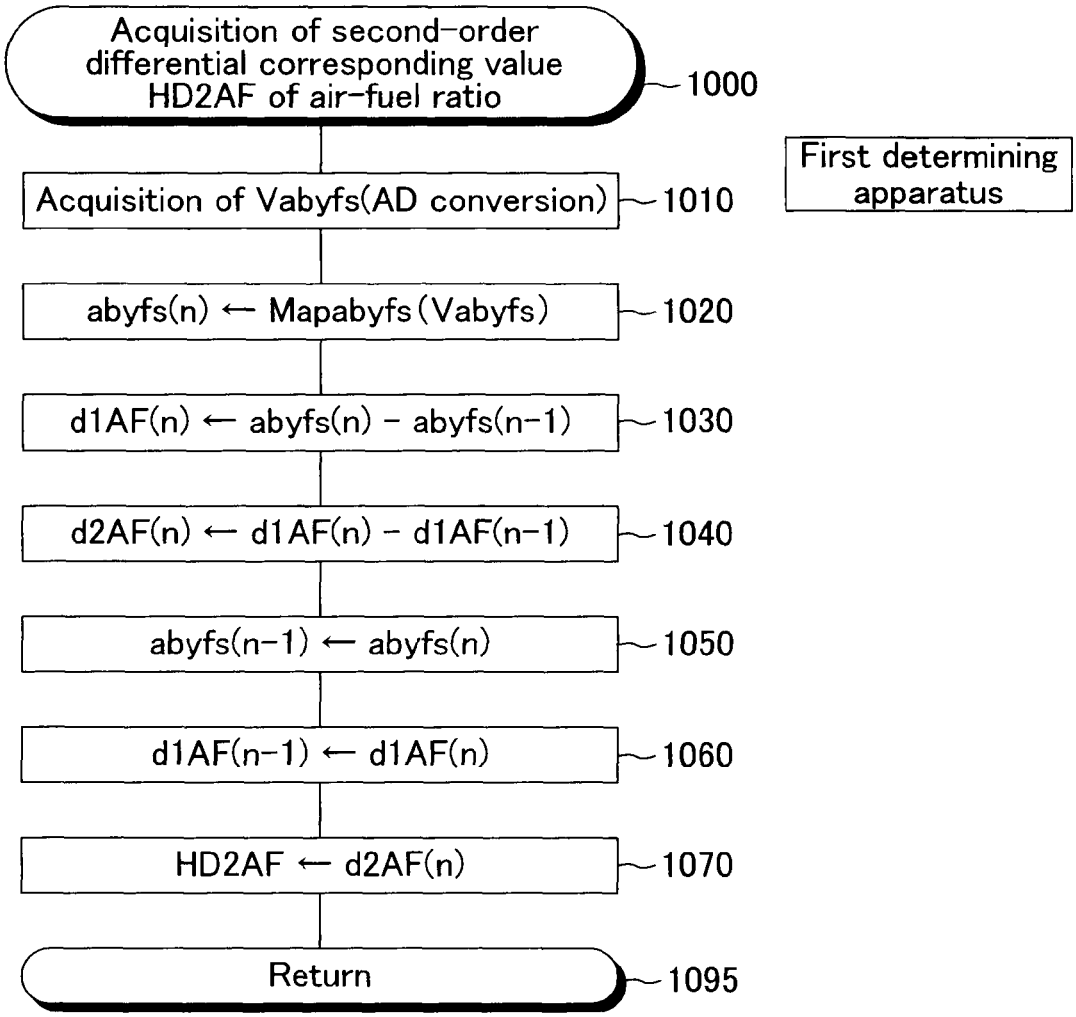
FIG. 10 is a flowchart showing a routine executed by the CPU of the electric control unit shown in FIG. 2.

In contrast, when the determination execution condition is satisfied, the CPU makes a "Yes" determination at step 1110 to proceed to step 1120, at which the CPU obtains the air-fuel ratio second-order differential corresponding value HD2AF which is obtained separately by the routine shown in FIG. 10.

Subsequently, the CPU proceeds to step 1130 to determine whether or not the absolute value |HD2AF| of the air-fuel ratio second-order differential corresponding value HD2AF is larger than the first threshold value Th1. The first threshold value Th1 is a positive value, and is experimentally determined in advance. When the absolute value |HD2AF| is larger than the first threshold value Th1, the CPU makes a "Yes" determination at step 1130 to proceed to step 1140, at which the CPU sets a value of an imbalance state in air-fuel ratios among the cylinders occurrence flag XINB (hereinafter, also refer to as an "imbalance occurrence flag XINB" to "1". That is, the CPU determines that the air-fuel ratio imbalance state among cylinders is occurring. Further, at this time point, the CPU may turn on an alarm lamp which is not shown. Thereafter, the CPU proceeds to step 1195 to end the present routine tentatively.

The value of this imbalance occurrence flag XINB (and a rich shift imbalance occurrence flag XINBR described later, a lean shift imbalance occurrence flag XINBL described later) is stored in the backup RAM. Further, the value of the imbalance occurrence flag XINB (and the rich shift imbalance occurrence flag XINBR described later, the lean shift imbalance occurrence flag XINBL described later) is set to (at) "0" by performing a specific operation upon the electric control unit 60, when it is confirmed that air-fuel ratio imbalance state among cylinders is not occurring, such as at a time of factory-shipment, checking of the vehicle on which the engine is mounted, or the like. Thereafter, the CPU proceeds to step 1195 to end the present routine tentatively.

In contrast, when the CPU executes the process of step 1130, and if the absolute value |HD2AF| of the air-fuel ratio second-order differential corresponding value HD2AF is equal to or smaller than the first threshold value Th1, the CPU makes a "No" determination at step 1130 to directly proceed to step 1195 to end the present routine tentatively.

As described before with reference to FIG. 1, when the air-fuel ratio imbalance state among cylinders is not occurring, the absolute value |d2AF|(=|HD2AF|) of the second-order differential value d2AF obtained as the air-fuel ratio second-order differential corresponding value HD2AF is never larger than the first threshold value Th1. Contrary to this, when the air-fuel ratio imbalance state among cylinders is occurring, the absolute value |d2AF|(−|HD2AF|) of the second-order differential value d2AF at a certain time point becomes larger than the first threshold value Th1. Therefore, according to the first determining apparatus, the air-fuel ratio imbalance among cylinders determining apparatus can be accurately carried out.

As described above, the first determining apparatus comprises the air-fuel ratio sensor 55 which is disposed at the exhaust gas aggregated portion 41*b* of an exhaust gas passage of an engine 10 where exhaust gases discharged from at least two or more of a plurality of the cylinders of that engine 10 are aggregated or at the portion downstream of the exhaust gas aggregated portion of the exhaust gas passage and upstream of the upstream catalyst 43, the air-fuel ratio sensor 55 including the air-fuel ratio detection element 55*a* and protection covers (55*b*, 55*c*) for accommodating the air-fuel ratio detection element in the interior thereof to cover the air-fuel ratio detection element, the protection covers having influent holes for having exhaust gas flowing through the exhaust gas passage flow into the interior of thereof and effluent holes for having the exhaust gas which has flowed into the interior thereof flow out to the exhaust gas passage, and the air-fuel ratio detection element generating the output in response to the air-fuel ratio of the exhaust gas reaching the air-fuel ratio detection element as the air-fuel ratio sensor output (output value Vabyfs).

The first determining apparatus further comprises imbalance determining means for obtaining the second-order differential value d2AF(n) of the "detected air-fuel ratio abyfs represented by the air-fuel ratio sensor output Vabyfs" with respect to time based on the air-fuel ratio sensor output Vabyfs (step 1010 to step 1060 of FIG. 10), obtaining the air-fuel ratio second-order differential corresponding value HD2AF varying in accordance with the obtained second-order differential value d2AF(n) based on the "obtained second-order differential value d2AF(n)" (step 1070 of FIG. 10), and determining (performing a determination as to or of) whether or not the air-fuel ratio imbalance state among cylinders is occurring based on the "obtained air-fuel ratio second-order differential corresponding value HD2AF" (step 1120 and step 1130 of FIG. 11).

That is, the first determining apparatus is configured so as to carry out the air-fuel ratio imbalance among cylinders determination utilizing the "air-fuel ratio second-order differential corresponding value HD2AF" whose absolute value never increases when the center of the air-fuel ratio of the engine 10 varies, but increases when the air-fuel ratio imbalance state among cylinders has occurred. Therefore, the first determining apparatus can perform the air-fuel ratio imbalance among cylinders determination more accurately.

The first determining apparatus obtains the air-fuel ratio second-order differential corresponding value HD2AF in such a manner that the air-fuel ratio second-order differential corresponding value HD2AF becomes larger as the obtained second-order differential value d2AF(n) is larger (step 1070 of FIG. 10). That is, the first determining apparatus is configured so as to obtain, as the air-fuel ratio second-order differential corresponding value HD2AF, the obtained second-order differential value d2AF(n) (step 1070 of FIG. 10).

Further, the first determining apparatus is configured so as to determine that the "air-fuel ratio imbalance state among cylinders is occurring", when the absolute value |HD2AF| of the obtained air-fuel ratio second-order differential corresponding value HD2AF is larger than the first positive threshold value Th1 (step 1130 and 1140 of FIG. 11).

According to this configuration, a parameter used in the air-fuel ratio imbalance among cylinders determination (the air-fuel ratio second-order differential corresponding value HD2AF) can be obtained by the simple configuration without using a complicated filter or the like.

Second Embodiment

An air-fuel ratio imbalance among cylinders determining apparatus (hereinafter, simply referred to as a "second determining apparatus") according to a second embodiment of the present invention will be described.

The second determining apparatus obtains a second-order differential value d2AF(n) every elapse of the sampling time period "ts" in a data acquisition time period (in this example, the above-mentioned unit combustion cycle period) longer than the sampling time period "ts" of the air-fuel ratio sensor output Vabyfs, and obtains, as the air-fuel ratio second-order differential corresponding value HD2AF, a second-order differential value d2AF(n) having the maximum absolute value |d2AF2(n)| among the second-order differential values d2AF (n) obtained within that unit combustion cycle period. Further, the second determining apparatus determines that the air-fuel ratio imbalance state among cylinders has occurred, when the absolute value |HD2AF| of that air-fuel ratio second-order differential corresponding value HD2AF is larger than a "predetermined positive first threshold value Th1". Except for this point, the second determining apparatus is the same as the first determining apparatus. Therefore, hereinafter, the description is focused on this point.

(Actual Operation)

Figure 9:
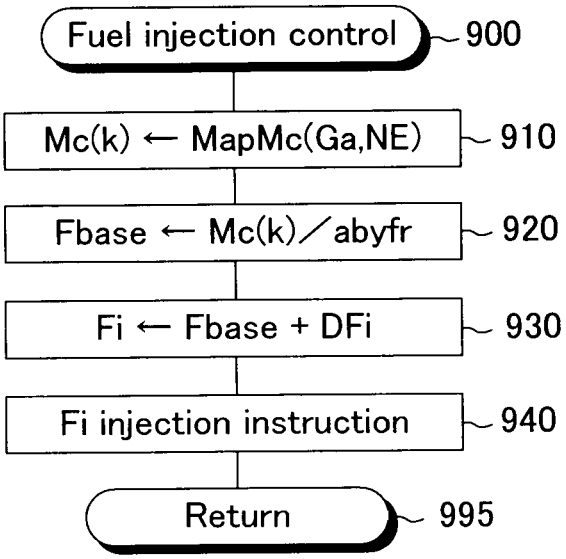
FIG. 9 is a flowchart showing a routine executed by a CPU of an electric control unit shown in FIG. 2.

The CPU of the second determining apparatus executes the routine shown in FIG. 9 as the CPU of the first determining apparatus does. In addition, the CPU of the second determining apparatus executes a "second-order differential value d2AF calculating routine" shown by a flowchart in FIG. 12 in place of FIG. 10 every time 4 ms (the sampling time period "ts") elapses. Note that, hereinafter, the symbols given to the steps which were already described are given to steps, each for carrying out process which is the same as one provided by the step already described.

Figure 12:
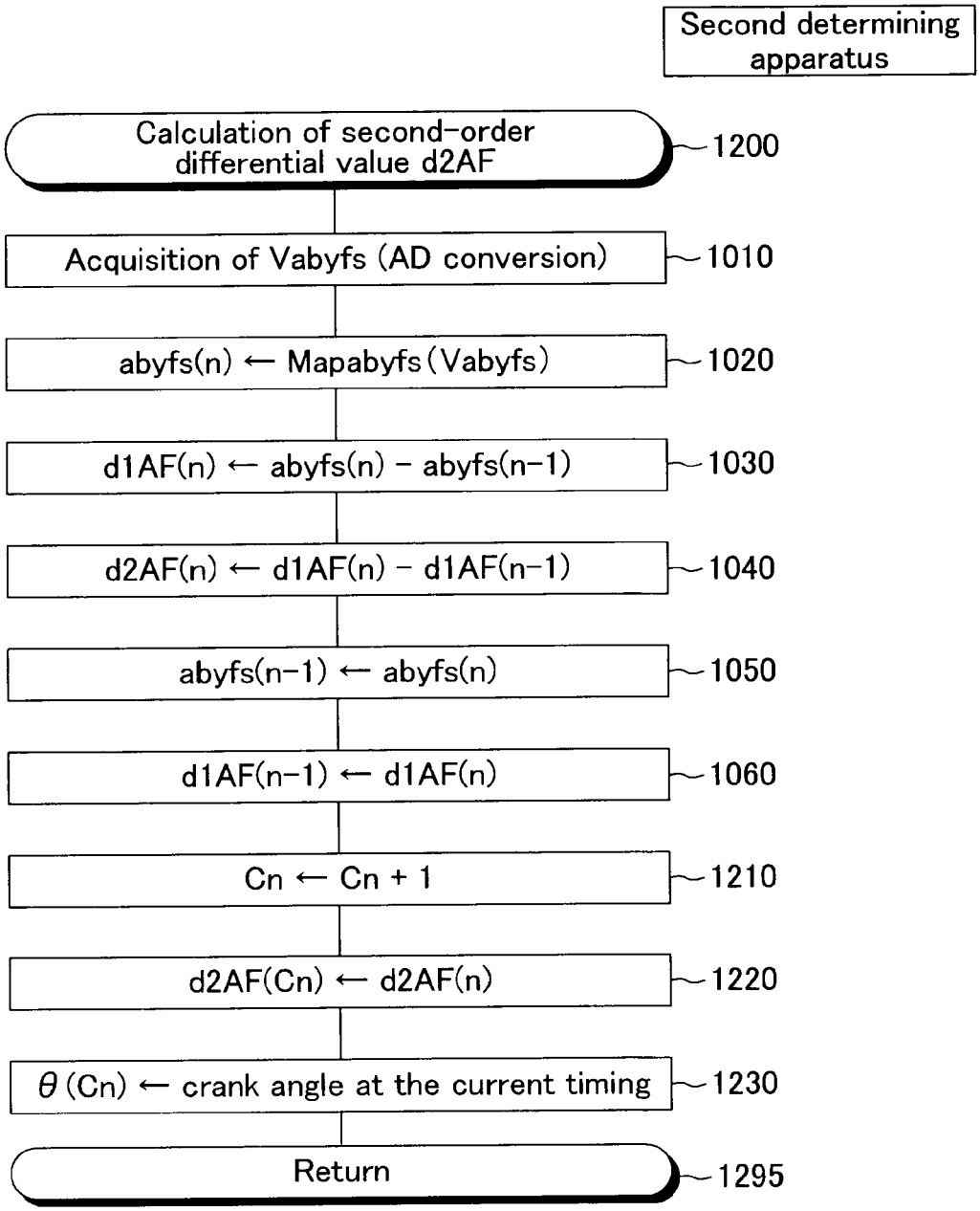
FIG. 12 is a flowchart showing a routine executed by a CPU of an air-fuel ratio imbalance among cylinders determining apparatus (a second determining apparatus) according to a second embodiment of the present invention.

At an appropriate time point, the CPU starts a process at step 1200 of FIG. 12, and carries out the above-mentioned processes of steps from step 1010 through step 1060. This allows the current second-order differential value d2AF(n) to be calculated (refer to step 1040).

Subsequently, the CPU sequentially carries out processes of steps from step 1210 to step 1230 described below, and proceeds to step 1295 to end the present routine tentatively.

Step 1210: The CPU increments a value of a counter Cn by "1". The value of the counter Cn is set to (at) "0" at step 1330 of FIG. 13 which will be described later, when one unit combustion cycle period has passed. Therefore, after the current (present) unit combustion cycle period starts, the value of the counter Cn is incremented by "1" every time one second-order differential value d2AF(n) is obtained.

Step 1220: The CPU stores the current second-order differential value d2AF(n) calculated at step 1040 into a held data second-order differential value d2AF(Cn). For example, when this routine is carried out for the first time after the current unit combustion cycle is started, the value of the counter Cn is set to (at) "1" at step 1210. Therefore, the second-order differential value d2AF(n) calculated at step 1040 is held as a held data second-order differential value d2AF(1). Note that, a held data second-order differential value d2AF(Cn) can also be referred to as an air-fuel second-order differential corresponding value HD2AF(Cn).

Step 1230: The CPU stores, as a crank angle data θ(Cn), the current crank angle (for example, an elapsed crank angle from a reference crank angle (0°), the reference crank angle being a top dead center of the first cylinder #1 which is a reference cylinder). That is, the value of the crank angle data θ(Cn) indicates a crank angle CA when the held data second-order differential value d2AF(Cn) is obtained.

Figure 13:
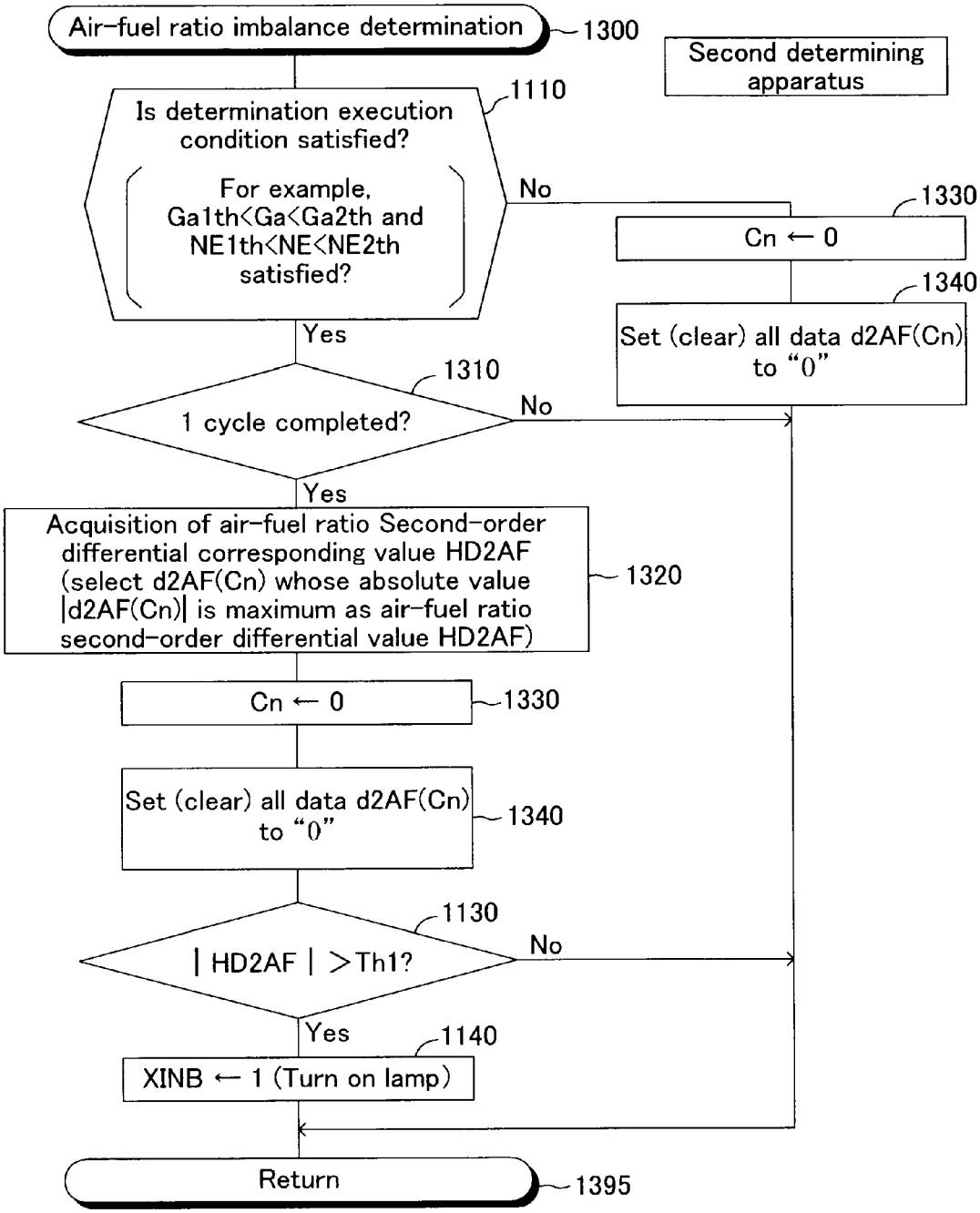
FIG. 13 is a flowchart showing a routine executed by a CPU of the second determining apparatus.

On the one hand, the CPU of the second determining apparatus is configured so as to execute an "air-fuel ratio imbalance among cylinders determination routine" shown by a flowchart of FIG. 13 in place of FIG. 11 every time the sampling time period "ts" elapses.

Therefore, at an appropriate time point, the CPU starts a process at step 1300, and proceeds to step 1110 to determine whether or not the determination execution condition of the air-fuel ratio imbalance among cylinders determination is satisfied.

When the determination execution condition is satisfied, the CPU makes a "Yes" determination at step 1110 to proceed to step 1310, at which the CPU determines whether or not one unit combustion cycle period (720° crank angle) has completed (passed). That is, the CPU determines whether or not the current time point coincides with the compression top dead center of the first cylinder #1 which is the reference cylinder. At this time, if one unit combustion cycle period has not passed, the CPU makes a "No" determination at step 1310 to directly proceed to step 1395 to end the present routine tentatively.

Thereafter, when one unit combustion cycle period has passed under a state where the determination execution condition has been satisfied, the CPU makes a "Yes" determination at step 1310 to proceed to step 1320, at which the CPU obtains, as an "air-fuel ratio second-order differential corresponding value HD2AF", a "second-order differential values d2AF(Cn) whose absolute value |d2AF(Cn)| is maximum" among a plurality of the second-order differential values d2AF(Cn) obtained within that elapsed unit combustion cycle period one.

Subsequently, the CPU sets (clears) the value of the counter Cn to "0". Next, the CPU proceeds to step 1340 to set (clear) all of a plurality of the second-order differential values d2AF (Cn) to (at) "0".

Thereafter, the CPU proceeds to step 1130 to determine whether or not the absolute value |HD2AF| of the air-fuel ratio second-order differential corresponding value HD2AF (obtained at step 1320) is larger than the first threshold value Th1.

When the absolute value |HD2AF| is larger than the first threshold value Th1, the CPU makes a "Yes" determination at step 1130 to proceed to step 1140, at which the CPU sets the value of the imbalance occurrence flag XINB to (at) "1". That is, the CPU determines that the air-fuel ratio imbalance state among cylinders is occurring. Further, at this time, the CPU may turn on an alarm lamp which is not shown. Thereafter, the CPU proceeds to step 1395 to end the present routine tentatively.

Contrary to this, when the CPU executes the process of step 1130, if the absolute value |HD2AF| is equal to or smaller than the first threshold value Th1, the CPU makes a "No" determination at step 1130 to proceed to step 1395 to end the present routine tentatively. In this manner, the air-fuel ratio imbalance among cylinders determination is carried out.

Note that, when the CPU executes the process of step 1110, and if the determination execution condition is not satisfied, the CPU makes a "No" determination at step 1110 to execute the processes of step 1330 and step 1340, and then proceeds directly to step 1395 to end the present routine tentatively. Therefore, in this case, the air-fuel ratio imbalance among cylinders determination is not carried out.

As described above, the second determining apparatus has imbalance determining means for obtaining a second-order differential value d2AF(n) of the detected air-fuel ratio abyfs with respect to time based on the air-fuel ratio sensor output Vabyfs (step 1010 to step 1060 of FIG. 12), obtaining, based on the "obtained second-order differential value d2AF(n)" an air-fuel ratio second-order differential corresponding value HD2AF varying in accordance with the obtained second-order differential value d2AF(n) (step 1320 of FIG. 13), and carrying out a determination of (as to) whether or not an air-fuel ratio imbalance state among the cylinders is occurring based on whether or not the "obtained air-fuel ratio second-order differential corresponding value HD2AF" is larger than the first threshold value Th1 (step 1130 of FIG. 13).

When the air-fuel ratio imbalance state among cylinders is occurring, the absolute value |HD2AF| of the "second-order differential value d2AF(n) having the maximum absolute value" among second-order differential values d2AF(Cn) obtained within one unit combustion cycle period becomes larger than the first threshold value Th1. Therefore, the second determining apparatus can more accurately carry out the air-fuel ratio imbalance among cylinders determination.

The second determining apparatus obtains the second-order differential values d2AF(Cn) obtained every elapse of the predetermined time period within one unit combustion cycle period (step 1040 and step 1220 of FIG. 21). Thereafter, the second determining apparatus obtains, as the air-fuel ratio second-order differential corresponding value HD2AF, one second-order differential value d2AF(Cn) whose absolute value is maximum" among a plurality of the second-order differential values d2AF(Cn) obtained within that unit combustion cycle period (step 1320 of FIG. 13).

According to this configuration, a parameter (air-fuel ratio second-order differential corresponding value HD2AF) used in the air-fuel ratio imbalance among cylinders determination can be obtained by a simple configuration without using complex filters or the like.

Third Embodiment

An air-fuel ratio imbalance among cylinders determining apparatus (hereinafter, simply referred to as a "third determining apparatus") according to a third embodiment of the present invention will be described.

Figure 1:
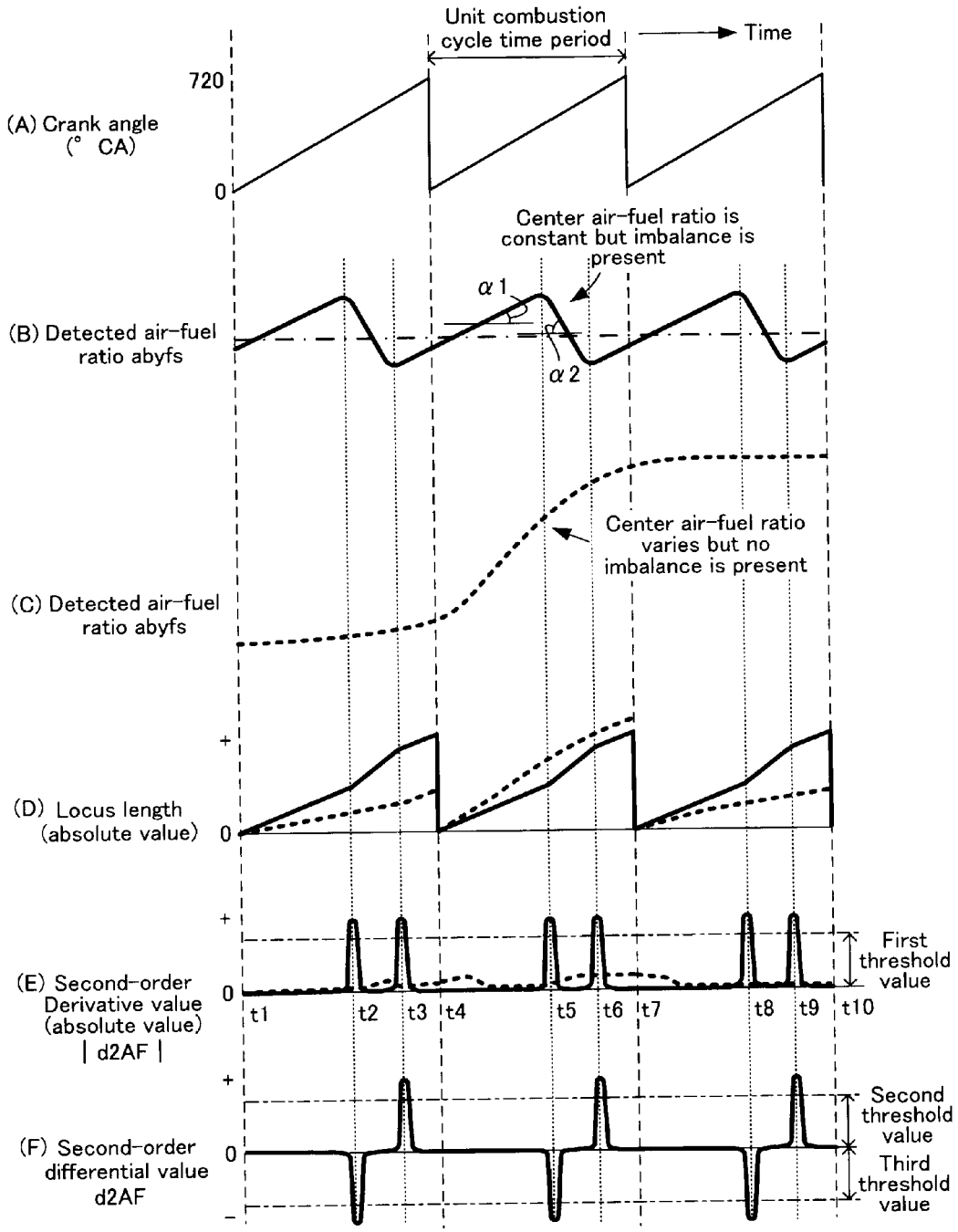

As shown in (F) of FIG. 1, when the air-fuel ratio imbalance state among cylinders is occurring, in one unit combustion cycle period, at least one second-order differential value d2AF having a positive value and being equal to or larger than a second threshold value Th2 (for example, refer to time t6) appears, and at least one second-order differential value d2AF, which has a negative value, and whose absolute value is equal to or larger than a third threshold value Th3 (for example, refer to time t5) appears.

In view of the above, the third determining apparatus is configured so as to determine that air-fuel ratio imbalance state among cylinders is occurring, when a second-order differential value d2AF having a positive value whose absolute value is equal to or larger than the second threshold value Th2 is present, and a second-order differential value d2AF having a negative value whose absolute value is equal to or larger than the third threshold value Th3 is present, among second-order differential values d2AF obtained in one unit combustion cycle period. Hereinafter, the description is focused on this point.

(Actual Operation)

The CPU of the third determining apparatus executes the routines shown in FIGS. 9 and 12, as the CPU of the second determining apparatus does. In addition, the CPU of the third determining apparatus executes an "air-fuel ratio imbalance among cylinders determination routine" shown by a flowchart in FIG. 14 in place of FIG. 13 every time 4 ms (the sampling time period "ts") elapses.

Therefore, at an appropriate time point, the CPU starts a process at step 1400 to proceed to step 1110, at which the CPU determines whether or not the determination execution condition of the air-fuel ratio imbalance among cylinders determination is satisfied.

When the determination execution condition is satisfied, the CPU makes a "Yes" determination at step 1110 to proceed to step 1310, at which the CPU determines whether or not one unit combustion cycle period (720° crank angle) has ended (passed). When one unit combustion cycle period has not passed, the CPU makes a "No" determination at step 1310 to directly proceed to step 1495 to end the present routine tentatively.

Thereafter, when one unit combustion cycle period has elapsed under a state where the determination execution condition has been satisfied, the CPU makes a "Yes" determination at step 1310 to proceed to step 1410, at which the CPU obtains, as the "positive-side air-fuel ratio second-order differential corresponding value Pd2AF", "one second-order differential value d2AF(Cn) whose absolute value |d2AF (Cn)| is largest" among the "second-order differential values d2AF(Cn), each having a positive value" among a "plurality of the second-order differential values d2AF(Cn)" obtained within one unit combustion cycle period which passed immediately before the current time point. The positive-side air-fuel ratio second-order differential corresponding value Pd2AF is one of the air-fuel ratio second-order differential corresponding values, and is also referred to as a positive-side maximum second-order differential corresponding value.

Subsequently, the CPU proceeds to step 1420 to obtain, as the "negative-side air-fuel ratio second-order differential corresponding value Md2AF", "one second-order differential value d2AF(Cn) whose absolute value |d2AF(Cn)| is largest" among the "second-order differential values d2AF(Cn), each having a negative value" among a "plurality of the second-order differential values d2AF(Cn)" obtained within the unit combustion cycle period which passed immediately before the current time point. The negative-side air-fuel ratio second-order differential corresponding value Pd2AF is one of the air-fuel ratio second-order differential corresponding values, and is also referred to as a negative-side maximum second-order differential corresponding value.

Thereafter, the CPU proceeds to step 1330 to set (clear) the value of the counter Cn to (at) "0". Then, the CPU proceeds to step 1340 to set (clear) all of a plurality of the second-order differential values d2AF(Cn).

Subsequently, the CPU proceeds to step 1430 to determine whether or not the absolute value of the positive-side air-fuel ratio second-order differential corresponding value Pd2AF is equal to or larger than the second threshold value Th2 and the absolute value of the negative-side air-fuel ratio second-order differential corresponding value Md2AF is equal to or larger than the third threshold value Th3. That is, the CPU determines whether or not, in one unit combustion cycle period, a second-order differential value d2AF having a positive value whose absolute value is equal to or larger than the second threshold value Th2 as well as a second-order differential value d2AF having a negative value whose absolute value is equal to or larger than the third threshold value Th3 are present. Note that both the second threshold value Th2 and the third threshold value Th3 are positive predetermined values, and are experimentally determined in advance. The second threshold value Th2 and the third threshold value Th3 may be the same to each other or different from each other.

When the absolute value of the positive-side air-fuel ratio second-order differential corresponding value Pd2AF is equal to or larger than the second threshold value Th2 and the absolute value of the negative-side air-fuel ratio second-order differential corresponding value Md2AF is equal to or larger than the third threshold value Th3, the CPU determines that the air-fuel ratio imbalance state among cylinders has occurred, and proceeds to step 1140 to set a value of an imbalance determination flag XINB to "1". At this time, the CPU further may turn on an alarm lamp which is not shown. Thereafter, the CPU proceeds to step 1495 to end the present routine tentatively.

Contrary to this, when the CPU executes the process of step 1430, and if the absolute value the positive-side second-order differential corresponding value Pd2AF is smaller than the second threshold value Th2, and/or the absolute value the negative-side second-order differential corresponding value Md2AF is smaller than the third threshold value Th3, the CPU makes a "No" determination at step 1430 to proceed to step 1495 to end the present routine tentatively. With the processes described above, the air-fuel ratio imbalance among cylinders determination is carried out.

Note that, when the CPU executes the process of step 1110, and if the determination execution condition is not satisfied, the CPU makes a "No" determination at step 1110, and the CPU executes the processes of step 1330 and step 1340, then to directly proceed to step 1495 to end the present routine tentatively. Therefore, in this case, the air-fuel ratio imbalance among cylinders determination is not carried out.

Figure 14:
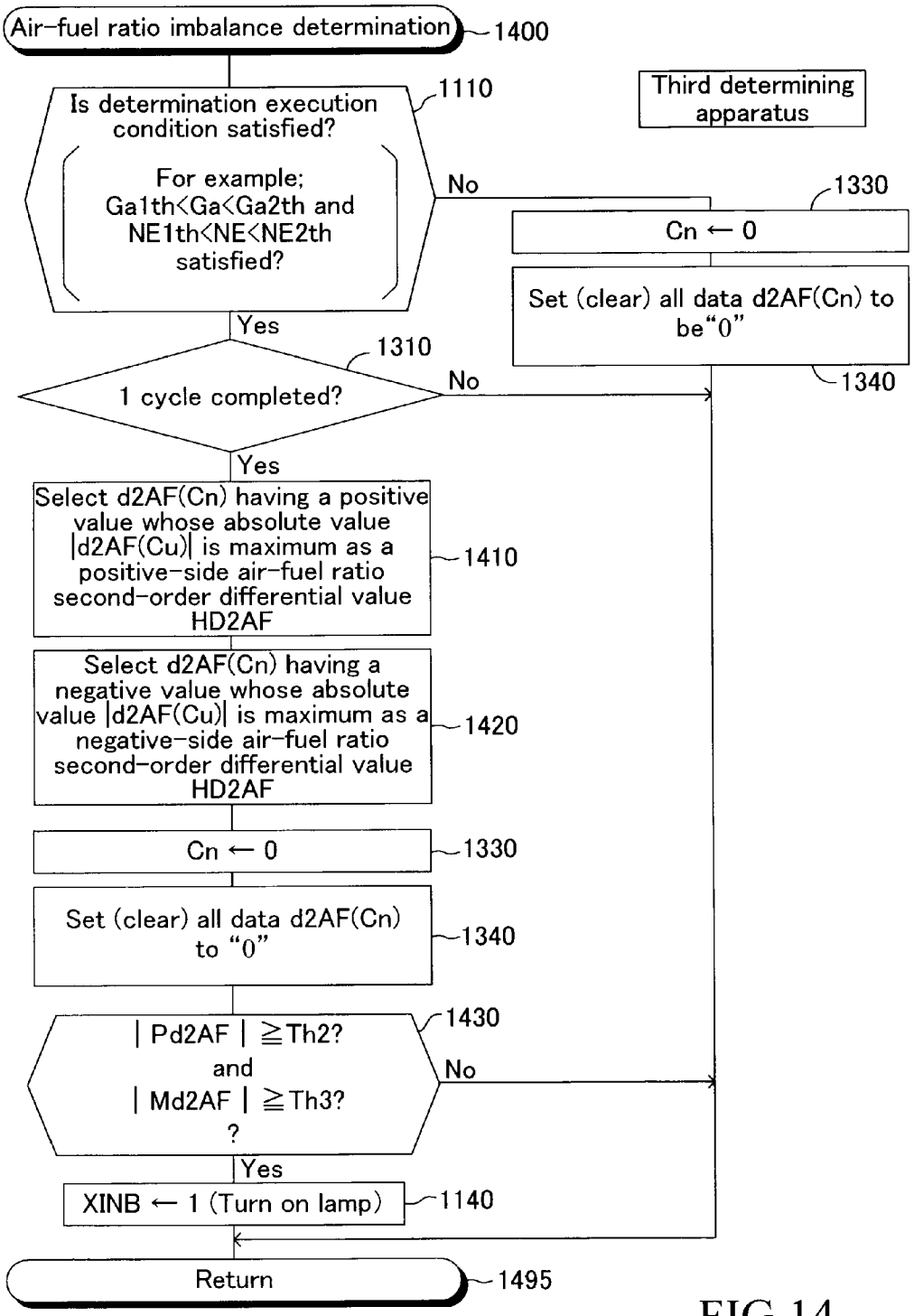
FIG. 14 is a flowchart showing a routine executed by a CPU of an air-fuel ratio imbalance among cylinders determining apparatus (a third determining apparatus) according to a third embodiment of the present invention.

As described above, the third determining apparatus has imbalance determining means for obtaining the second-order differential value d2AF(n) of the detected air-fuel ratio abyfs with respect to time based on the air-fuel ratio sensor output Vabyfs (step 1010 to step 1060 of FIG. 12), obtaining "the positive-side air-fuel ratio second-order differential corresponding value Pd2AF and the negative-side air-fuel ratio second-order differential corresponding value Md2AF", both serving as the air-fuel ratio second-order differential corresponding values HD2AF varying in accordance with the obtained second-order differential value d2AF(n), based on the "obtained second-order differential value d2AF(n)" (step 1220 of FIG. 12, and steps 1410 and 1420 of FIG. 14), and carrying out the determination of (as to) whether or not an air-fuel ratio imbalance among cylinders determination is occurring, based on whether or not "the positive-side second-order differential corresponding value Pd2AF and the negative-side second-order differential corresponding value Md2AF", serving as the obtained air-fuel ratio second-order differential corresponding values HD2AF, are larger than the second threshold value Th2 and the third threshold value Th3, respectively (step 1430 of FIG. 14).

That is, the imbalance determining means of the third determining apparatus is configured so as to determine that the air-fuel ratio imbalance state among cylinders is occurring, when, among a plurality of the air-fuel ratio second-order differential corresponding values which are obtained in the unit combustion cycle period, an air-fuel ratio second-order differential corresponding value having a positive value whose absolute value is equal to or larger than the second threshold value and an air-fuel ratio second-order differential corresponding value having a negative value whose absolute value is equal to or larger than the third threshold value are present (refer to step 1430 of FIG. 14).

When the air-fuel ratio imbalance state among cylinders occurs, "the positive-side air-fuel ratio second-order differential corresponding value Pd2AF and the negative-side air-fuel ratio second-order differential corresponding value Md2AF" become larger than "the second threshold value Th2 and the third threshold value Th3", respectively, in one unit combustion cycle period. Therefore, even when the absolute value of any one of "the positive-side air-fuel ratio second-order differential corresponding value Pd2AF and the negative-side air-fuel ratio second-order differential corresponding value Md2AF" become larger due to the noises and so on while the air-fuel ratio imbalance state among cylinders is not occurring, the third determining apparatus does not determine that the air-fuel ratio imbalance state among cylinders is occurring. Therefore, the third determining apparatus can more accurately perform the air-fuel ratio imbalance among cylinders determination.

Fourth Embodiment

An air-fuel ratio imbalance among cylinders determining apparatus according to a fourth embodiment of the present invention (hereinafter, simply referred to as a "fourth determining apparatus" will next be described.

In the same way as the third determining apparatus, the fourth determining apparatus obtains the positive-side air-fuel ratio second-order differential corresponding value Pd2AF and the negative-side air-fuel ratio second-order differential corresponding value Md2AF. In addition, the fourth determining apparatus is configured so as to determine that the air-fuel ratio imbalance state among cylinders is occurring, when their product (Pd2AF·Md2AF) is equal to or smaller than a negative threshold value Sth. Hereinafter, the description is focused on this point.

(Actual Operation)

The CPU of the fourth determining apparatus executes the routines shown in FIGS. 9 and 12 as the CPU of the second determining apparatus does. In addition, the CPU of the fourth determining apparatus executes an "air-fuel ratio imbalance among cylinders determination routine" shown by a flowchart in FIG. 15 in place of FIG. 13 every time 4 ms (the sampling time period "ts") elapses.

Figure 15:
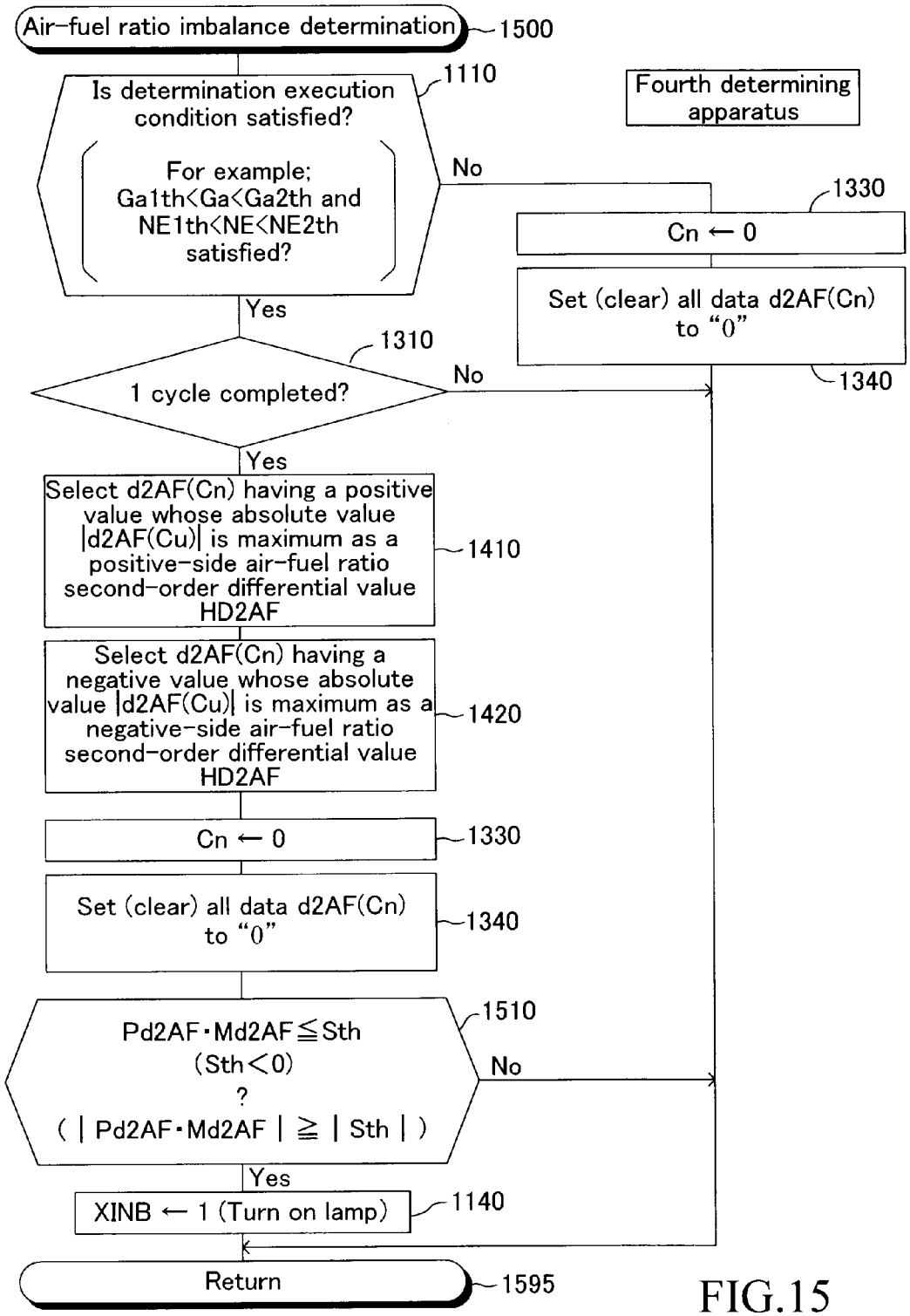
FIG. 15 is a flowchart showing a routine executed by a CPU of an air-fuel ratio imbalance among cylinders determining apparatus (a fourth determining apparatus) according to a fourth embodiment of the present invention.

The routine shown in FIG. 15 is different from the routine shown in FIG. 14 only in that step 1430 of the routine shown in FIG. 14 is replaced by step 1510. That is, the CPU obtains the positive-side air-fuel ratio second-order differential corresponding value Pd2AF at step 1410, and the negative-side air-fuel ratio second-order differential corresponding value Md2AF at step 1420.

Then, at step 1510, the CPU determines whether or not a product (Pd2AF·Md2AF) of the positive-side air-fuel ratio second-order differential corresponding value Pd2AF and the negative-side air-fuel ratio second-order differential corresponding value Md2AF is equal to or smaller than the negative threshold value Sth.

When the product (Pd2AF·Md2AF) is equal to or smaller than the negative threshold value Sth, the CPU determines that the air-fuel ratio imbalance state among cylinders has occurred, and proceeds to step 1140 to set the value of the imbalance determination flag XINB to (at) "1". At this time, the CPU may further turn on an alarm lamp which is not shown. Thereafter, the CPU proceeds to step 1595 to end the present routine tentatively.

Contrary to this, when the CPU executes the process of step 1510, and if the product (Pd2AF·Md2AF) is larger than the negative threshold value Sth, the CPU makes a "No" determination at step 1510 to proceed to step 1595 to end the present routine tentatively. With the processes described above, the air-fuel ratio imbalance among cylinders determination is carried out.

Note that, when the CPU executes the process of step 1110, and if the determination execution condition is not satisfied, the CPU makes a "No" determination at step 1110 to execute the processes of step 1330 and step 1340, and then, directly proceeds to step 1595 to end the present routine tentatively. Therefore, in this case, the air-fuel ratio imbalance among cylinders determination is not carried out.

As explained above, imbalance determining means of the fourth determining apparatus is configured so as to:

obtain, as an air-fuel ratio second-order differential corresponding value d2AF(Cn), the second-order differential value d2AF(n) obtained every elapse of a predetermined time period "ts" in one unit combustion cycle period (the process of step 1220 of FIG. 12 corresponds to this process);

select a positive-side maximum second-order differential corresponding value Pd2AF whose absolute value is largest among the air-fuel ratio second-order differential corresponding values, each having a positive value, out of a plurality of the air-fuel ratio second-order differential corresponding values d2AF(Cn) obtained within the unit combustion cycle period (refer to step 1410 of FIG. 15);

select a negative-side maximum second-order differential corresponding value Pd2AF whose absolute value is largest among the air-fuel ratio second-order differential corresponding values, each having a negative value, out of a plurality of the air-fuel ratio second-order differential corresponding values d2AF(Cn) obtained within the unit combustion cycle period (refer to step 1420 of FIG. 15); and further determine that the air-fuel ratio imbalance state among cylinders is occurring, when the product (Pd2AF·Md2AF) of the positive-side maximum second-order differential corresponding value and the negative-side maximum second-order differential corresponding value is equal to or smaller than the predetermined negative threshold value Sth (refer to step 1510 of FIG. 15).

As is clear from (F) of FIG. 1, when the air-fuel ratio imbalance state among cylinders has occurred, the second-order differential value of the detected air-fuel ratio reaches the positive value whose absolute value is not smaller than a predetermined value (the second threshold value) and a negative value whose absolute value is not smaller than a predetermined value (the third threshold value) within one unit combustion cycle period. Therefore, when the air-fuel ratio imbalance state among cylinders has occurred, the product (Pd2AF·Md2AF) of the positive-side maximum second-order corresponding value and the negative-side maximum second-order corresponding value becomes equal to or smaller than the "predetermined negative threshold value Sth". Therefore, according to the fourth determining apparatus, an occurrence of the air-fuel ratio imbalance state among cylinders can be determined more certainly, based on a simple technique.

It should be noted that the CPU may be configured so as to determine whether or not an absolute value |Pd2AF·Md2AF| of the product (Pd2AF·Md2AF) is equal to or larger than an absolute value |Sth| of the above-mentioned negative threshold value Sth. Such a process is equivalent to a process of determining whether or not the product (Pd2AF·Md2AF) is equal to or smaller than the negative threshold value Sth.

Fifth Embodiment

An air-fuel ratio imbalance among cylinders determining apparatus according to a fifth embodiment of the present invention (hereinafter, simply referred to as a "fifth determining apparatus" will next be described.

The fifth determining apparatus is a modification of the third determining apparatus or the fourth determining apparatus. That is, in addition to the routines carried out by each of the CPUs of the third determining apparatus and the fourth determining apparatus, a CPU of the fifth determining apparatus executes an "air-fuel ratio imbalance among cylinders determination routine" shown by a flowchart in FIG. 16. Thus, the fifth determining apparatus identify which cylinder is a cylinder to which an air-fuel mixture whose air-fuel ratio greatly deviates from the stoichiometric air-fuel ratio is supplied (i.e., which cylinder is an air-fuel ratio abnormality cylinder). Therefore, processes of the CPU according to the routine shown in FIG. 16 will next be described.

Figure 16:
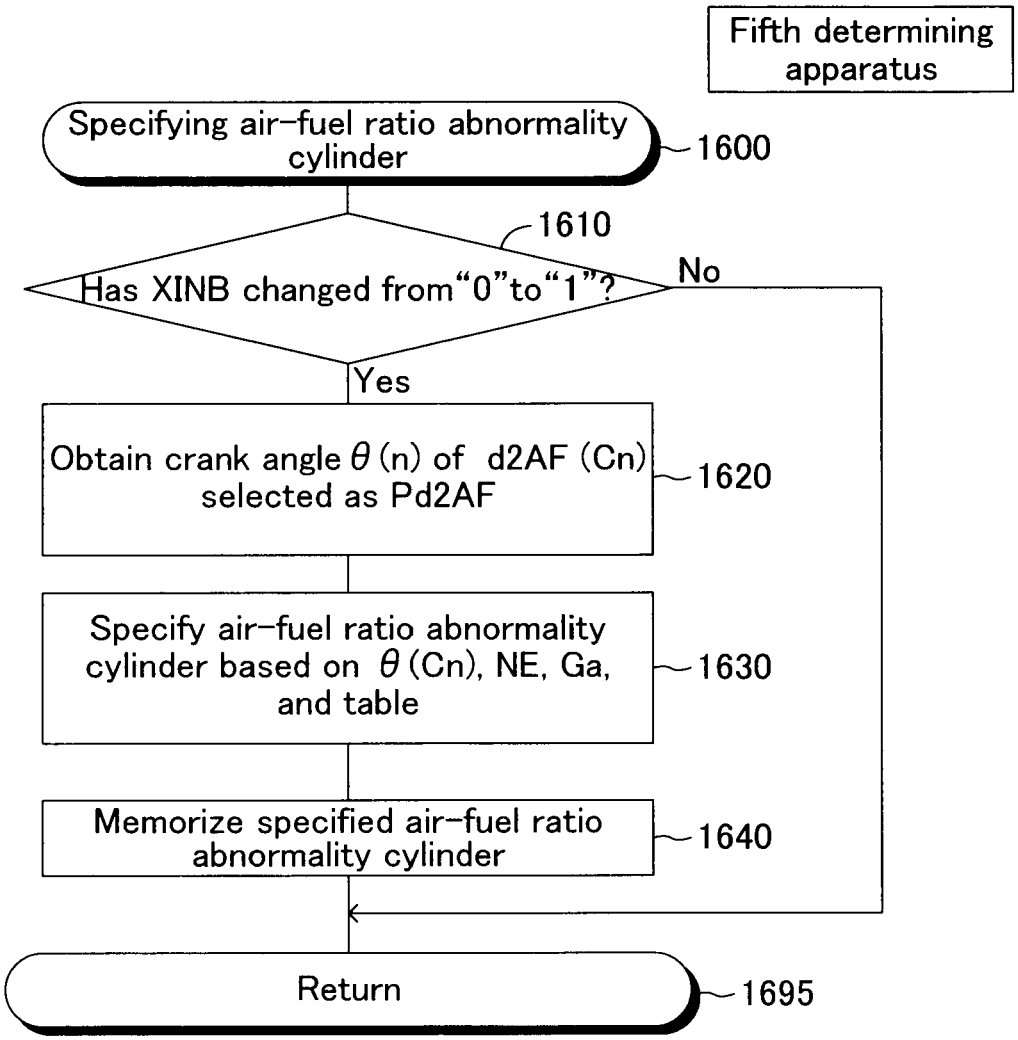
FIG. 16 is a flowchart showing a routine executed by a CPU of an air-fuel ratio imbalance among cylinders determining apparatus (a fifth determining apparatus) according to a fifth embodiment of the present invention.

The CPU is configured so as to execute the routine shown by the flowchart in FIG. 16 every time a predetermined time period elapses. Therefore, at an appropriate time point, the CPU starts a process of step 1600 of FIG. 16, and proceeds to step 1610, at which the CPU determines whether or not the current time point is a "time point immediately after the value of the imbalance occurrence flag XINB is charged from "0" to "1".

When the current time point is not the "timing immediately after the value of the imbalance occurrence flag XINB is charged from "0" to "1"", the CPU makes a "No" determination at step 1610, and directly proceeds to step 1695 to end the present routine tentatively.

On the other hand, when the current timing is the "timing immediately after the value of the imbalance occurrence flag XINB is charged from "0" to "1"", the CPU makes a "Yes" determination at step 1610 to sequentially executes processes of steps from step 1620 to step 1640 described below, and proceeds to step 1695 to end the present routine tentatively.

Step 1620: The CPU obtains a crank angle θ(Cn) at a time point when the second-order differential value d2AF(Cn) as the positive-side air-fuel ratio second-order differential corresponding value (the positive-side maximum second-order differential value) Pd2AF was obtained. This crank angle is read out, based on the value of the counter Cn, from the data stored at step 1230 of FIG. 12.

Step 1630: The CPU identifies an air-fuel ratio abnormality cylinder based on the crank angle θ(Cn) obtained at step 1620, the engine rotational speed NE, the intake air flow rate Ga, and an air-fuel ratio abnormality cylinder determination table (map). More specifically, when the air-fuel ratio of the air-fuel mixture supplied to an N-th cylinder greatly deviates from the stoichiometric air-fuel ratio at a certain engine rotational speed NE and a certain intake air flow rate GA, a crank angle (hereinafter, refer to as a "positive peak generating crank angle θa") at which the second-order differential value d2AF(Cn) which is selected as the positive-side maximum second-order differential value Pd2AF appears is in the vicinity of a specific crank angle.

In view of the above, an relationship among "an engine rotational speed NE and an intake air flow amount Ga", "the positive-side peak generating crank angle θa", and "an N-th cylinder where an air-fuel ratio abnormality is occurring" is experimentally obtained in advance, and the relationship is stored in a form of table in the ROM. The CPU applies an actually-obtained positive-side peak generating crank angle θa, an actual engine rotational speed NE, and an actual intake air flow rate GA, to this table to identify the air-fuel ratio abnormality cylinder.

Step 1640: The CPU stores the cylinder identified at step 1630 as the air-fuel ratio abnormality cylinder in the backup RAM.

As described above, the fifth determining apparatus is configured so as to:

obtain the "second-order differential value d2AF(n) of the detected air-fuel ratio with respect to time" obtained every elapse of a predetermined time period "ts" in one unit combustion cycle period (step 1010 to step 1060 of FIG. 12);

identify a time point (crank angle θ(Cn)) at which the "positive-side maximum second-order differential value Pd2AF whose absolute value is largest" emerges, the positive-side maximum second-order differential value Pd2AF being obtained from the "second-order differential values, each having a positive value" out of a plurality of the air-fuel ratio second-order differential values obtained within the unit combustion cycle period (refer to step 1620 of FIG. 16, step 1410 of FIG. 14 or FIG. 15, and step 1230 of FIG. 12); and determine, based on the identified time point, "which air-fuel ratio of a cylinder of the at least two cylinders is abnormal" when it is determined that the air-fuel ratio imbalance state among cylinders is occurring (step 1630 of FIG. 16).

Therefore, when it is determined that the air-fuel ratio imbalance state among cylinders is occurring, the fifth determining apparatus can determine which cylinder causes that air-fuel ratio imbalance state among cylinders (i.e., which cylinder has a mixture whose air-fuel ratio greatly deviates from the stoichiometric air-fuel ratio).

Further, the CPU according to an modification of the fifth determining apparatus may obtain, at step 1620, a "crank angle θ(Cn) at the time point when the second-order differential value d2AF(Cn) selected as the negative-side maximum air-fuel ratio second-order differential corresponding value Md2AF is obtained, i.e., the negative-side peak generation crank angle θb", instead of the "crank angle θ(Cn) at the time point when the second-order differential value d2AF (Cn) selected as the positive-side maximum air-fuel ratio second-order differential corresponding value Pd2AF is obtained, i.e., the positive-side maximum peak generation crank angle θa". In this case, a relationship among "an engine rotational speed NE and an intake air flow rate Ga", "a negative-side peak generating crank angle θb", and "an N-th cylinder where an air-fuel ratio abnormality is occurring" is experimentally obtained in advance, and the relationship is stored in a form of a table in the ROM, the table being a table used at step 1630. Then, the CPU applies to this table an actually-obtained negative-side peak generating crank angle θb, an actual engine rotational speed NE, and an actual intake air flow rate Ga, to identify an air-fuel ratio abnormality cylinder.

That is, the modification of the fifth determining apparatus is configured so as to:

obtain a "second-order differential value d2AF(n) of the detected air-fuel ratio with respect to time" obtained every elapse of a predetermined time period "ts" within one unit combustion cycle period (step 1010 to step 1060 of FIG. 12);

identify a time point when the "negative-side maximum second-order differential value Md2AF whose absolute value is largest" emerges among the "second-order differential values, each having a negative value" out of a plurality of the air-fuel ratio second-order differential values obtained within the unit combustion cycle period (refer to a modified step 1620 of FIG. 16, step 1410 of FIG. 14 or FIG. 15, and step 1230 of FIG. 12); and determine, based on the identified time point, "which air-fuel ratio of a cylinder of the at least two cylinders is abnormal" when it is determined that the air-fuel ratio imbalance state among cylinders is occurring (step 1630 of FIG. 16).

Therefore, when it is determined that the air-fuel ratio imbalance state among cylinders is occurring, the modification of the fifth determining apparatus can determine which cylinder causes that air-fuel ratio imbalance state among cylinders (i.e., which cylinder has a mixture whose air-fuel ratio greatly deviates from the stoichiometric air-fuel ratio).

Sixth Embodiment

An air-fuel ratio imbalance among cylinders determining apparatus according to a sixth embodiment of the present invention (hereinafter, simply referred to as a "sixth determining apparatus" will next be described.

Figure 17:
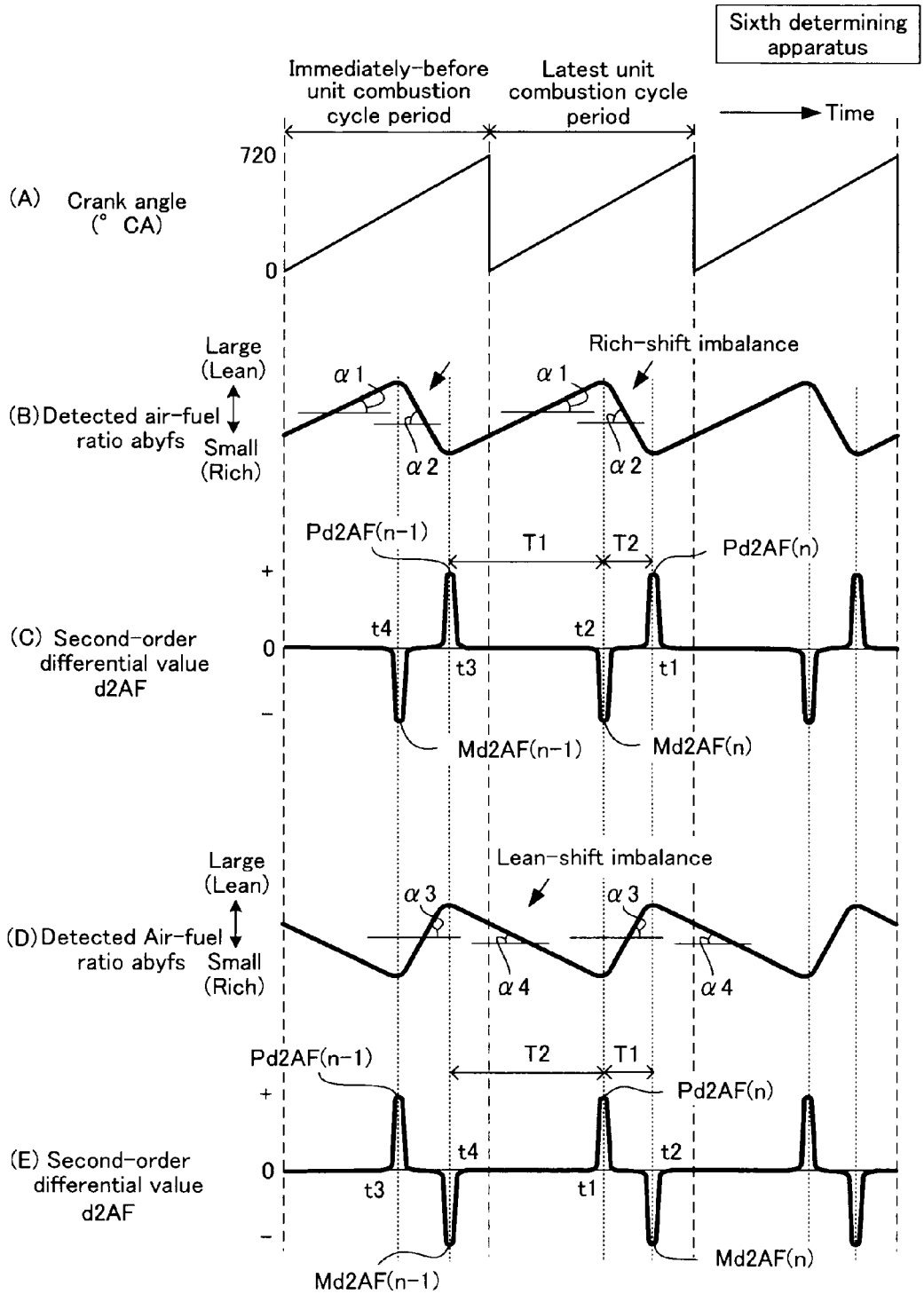
FIG. 17 is a timing chart for explaining a determination principle of an air-fuel imbalance determining apparatus among cylinders (a sixth determining apparatus) according to a sixth embodiment of the present invention.

According to the experiments, as shown in (B) of FIG. 17, when "a rich-shift imbalance state" has occurred, an absolute value (magnitude of an inclination (slope) α1) of a change rate of the detected air-fuel ratio (i.e., a time differential value of the detected air-fuel ratio) while the detected air-fuel ratio is increasing is smaller than an absolute value (magnitude of an inclination (slope) α2) of a change rate of the detected air-fuel ratio while the detected air-fuel ratio is decreasing. Therefore, the detected air-fuel ratio is relatively-rapidly decreases after the detected air-fuel ratio relatively-moderately increases.

Therefore, as shown in (C) of FIG. 17, a time point (first time point t1) when the "positive-side maximum second-order differential value whose absolute value is largest" out of the second-order differential values, each having a positive value, among a plurality of the second-order differential values obtained within one unit combustion cycle period emerges occurs immediately after a time point (second time point t2) when the "negative-side maximum second-order differential value whose absolute value is largest" out of the second-order differential values, each having a negative value, among a plurality of the second-order differential values obtained within that unit combustion cycle period emerges.

Contrary to this, as shown in (D) of FIG. 17, when the "lean-shift imbalance state" has occurred, an absolute value (magnitude of an inclination (slope) $\alpha$3) of the change rate of the detected air-fuel ratio while the detected air-fuel ratio is increasing is larger than an absolute value (magnitude of an inclination (slope) $\alpha$4) of the change rate of the detected air-fuel ratio while the detected air-fuel ratio is decreasing. Therefore, the detected air-fuel ratio is relatively-moderately decreases after the detected air-fuel ratio relatively-rapidly increases.

Therefore, as shown in (E) of FIG. 17, a time point (second time point t2) when the "negative-side maximum second-order differential value whose absolute value is largest" out of the second-order differential values, each having a negative value, among a plurality of the second-order differential values obtained within one unit combustion cycle period emerges occurs immediately after a time point (first time point t1) when the "positive-side maximum second-order differential value whose absolute value is largest" out of the second-order differential values, each having a positive value, among a plurality of the second-order differential values obtained within that unit combustion cycle period emerges.

According to such facts, when a time period from a "time point when the positive-side maximum second-order differential value emerges (is found)" to a "time point when the negative-side maximum second-order differential value subsequent to that positive-side maximum second-order differential value" emerges (is found) is defined as a first time period T1, and when a time period from a "time point when the negative-side maximum second-order differential value emerges (is found)" to a "time point when the positive-side maximum second-order differential value subsequent to that negative-side maximum second-order differential value emerges (is found)" is defined as a second time period T2, a relationship described below is established.

(1) When the "rich-shift imbalance state" has occurred, the first time period T1 becomes longer than the second time period T2 (refer to (C) of FIG. 17).

(2) When the "lean-shift imbalance state" has occurred, the first time period T1 is shorter than the second time period T2 (refer to (E) of FIG. 17).

In view of the above, when the air-fuel ratio imbalance state among cylinders has occurred, the sixth determining apparatus determines whether it is "a rich-shift imbalance state" or "a lean-shift imbalance state".

The sixth determining apparatus is a modification of any one of the third to fifth determining apparatuses. That is, in addition to the routines executed by the CPU of any of the third to fifth determining apparatuses, the CPU of the sixth determining apparatus executes an "imbalance tendency identifying routine" shown by a flowchart in FIG. 18.

Figure 18:
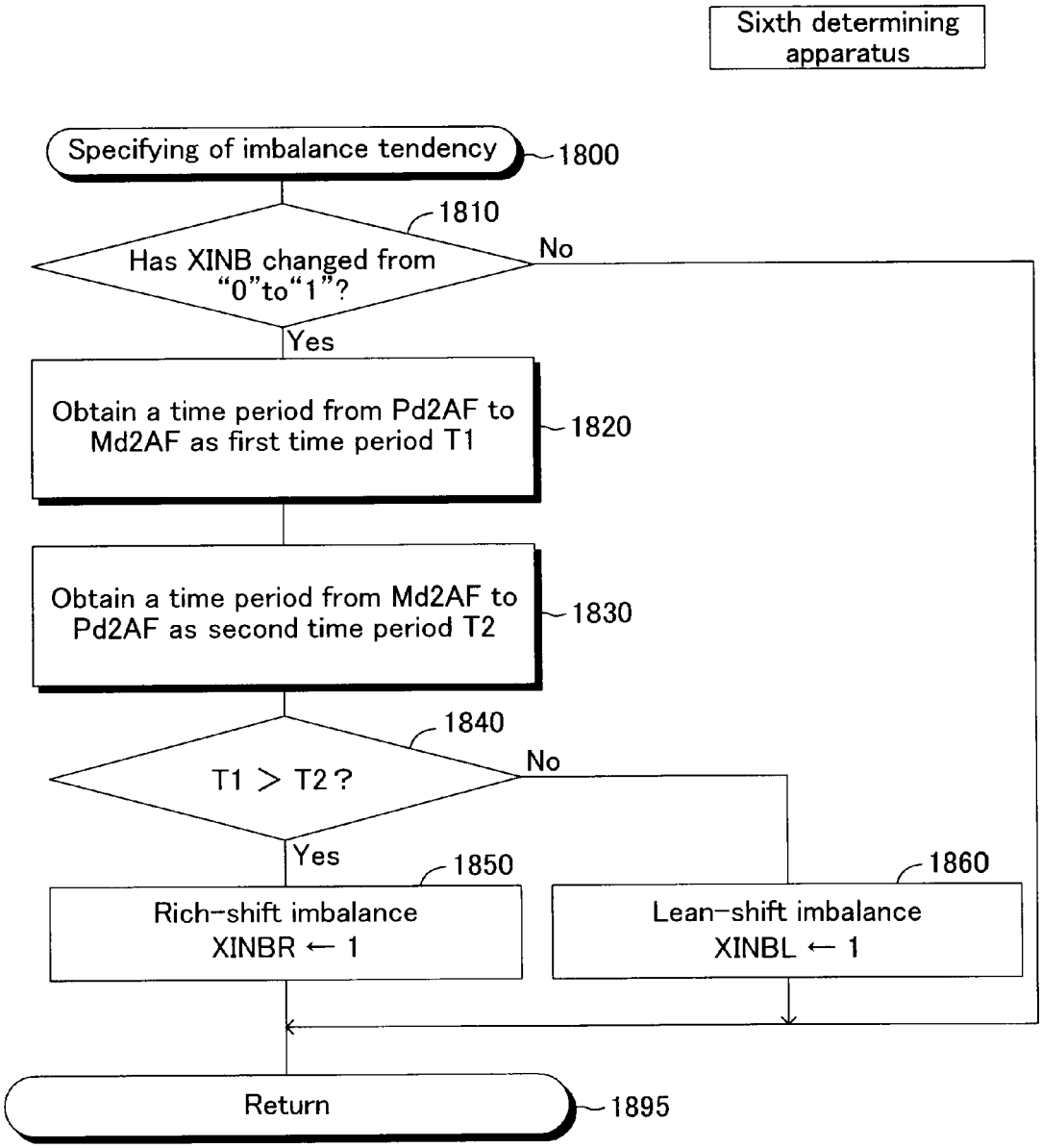
FIG. 18 is a flowchart showing a routine executed by a CPU of the sixth determining apparatus.

Therefore, at an appropriate timing, the CPU starts a process of step 1800 of FIG. 18, and proceeds to step 1810 to determine whether or not the current time point is a "time point immediately after the value of the imbalance determination flag XINB is charged from "0" to "1"". That is, the CPU determines whether or not the current time point is immediately after it is determined that the air-fuel ratio imbalance state among cylinders has occurred.

When the current time point is not the "time point immediately after the value of the imbalance determination flag XINB is charged from "0" to "1"", the CPU makes a "No" determination at step 1810, and directly proceeds to step 1895 to end the present routine tentatively.

On the other hand, when the current time point is the "time point immediately after the value of the imbalance determination flag XINB is charged from "0" to "1"", the CPU makes a "Yes" determination at step 1810 to proceed to step 1820, at which the CPU obtains the above-mentioned first time period T1.

In more detail, the CPU carries out the following processes.

(1) When a latest unit combustion cycle period has passed, the CPU obtains and stores a first time point t1 at which the "positive-side maximum second-order differential value Pd2AF(n) whose absolute value is largest" emerges, among "second-order differential values, each having a positive value", out of a "plurality of the second-order differential values obtained within that latest unit combustion cycle period".

(2) When that latest unit combustion cycle period has passed, the CPU obtains and stores a second time point t2 at which the "negative-side maximum second-order differential value Md2AF(n) whose absolute value is largest" emerges, among "second-order differential values, each having a negative value", out of a "plurality of the second-order differential values obtained within that latest unit combustion cycle period".

(3) When a unit combustion cycle period immediately before the above-mentioned latest unit combustion cycle period has passed, the CPU obtains and stores a third time point t3 at which a "positive-side maximum second-order differential value Pd2AF(n−1) whose absolute value is largest" emerges, among "second-order differential values, each having a positive value" out of a "plurality of second-order differential values obtained within that immediately-before unit combustion cycle period".

(4) When that unit combustion cycle period immediately before the latest unit combustion cycle period has passed, the CPU obtains and stores a fourth time point t4 at which a "negative-side maximum second-order differential value Md2AF(n−1) whose absolute value is largest" emerges, among "second-order differential values, each having a negative value" out of a "plurality of the second-order differential values obtained within that immediately-before unit combustion cycle period".

When the first time point t1 is before the second time point t2, the CPU obtains a time period from the first time point t1 to the second time point t2 as the first time period T1 (refer to (E) of FIG. 17). In contrast, when the first time point t1 is after the second time point t2, the CPU obtains a time period from the third time point t3 to the second time point t2 as the first time period T1 (refer to (C) of FIG. 17).

Subsequently, the CPU proceeds to step 1830 of FIG. 18 to obtain the second time period T2. More specifically, the CPU carries out the following processes.

When the first time point t1 is before the second time point t2, the CPU obtains a time period from the fourth time point t4 to the first time point t1 as the second time period T2 (refer to (E) of FIG. 17). In contrast, when the first time point t1 is after the second time point t2, the CPU obtains a time period from the second time point t2 to the first time point t1 as the second time period T2 (refer to (C) of FIG. 17).

Next, the CPU proceeds to step 1840 to determine whether or not the first time period T1 is longer than the second time period T2. When the first time period T1 is longer than the second time period T2, the CPU makes a "Yes" determination at step 1840 to proceed to step 1850, at which the CPU set a value of a "rich-shift generation flag XINBR" to (at) "1" for indicating that the rich-shift imbalance state is occurring.

In contrast, when the first time period T1 is shorter than the second time period T2, the CPU makes a "No" determination at step 1840 to proceed to step 1860, at which the CPU set a value of a "lean-shift generation flag XINBL" to (at) "1" for indicating that the lean-shift imbalance state is occurring.

In this manner, when it is determined that the air-fuel ratio imbalance state among cylinders has occurred (refer to step 1810), the sixth determining apparatus can identify (determine) whether the "rich-shift imbalance state" is occurring or the "lean-shift imbalance state" is occurring, based on a magnitude relation between the first time period T1 and the second time period T2 (refer to step 1840).

As described above, the air-fuel ratio imbalance among cylinders determining apparatus according to the present invention can accurately determine whether or not the air-fuel ratio imbalance state among cylinders has occurred.

Note that some CPUs of the above-mentioned determining apparatuses obtain the second-order differential value d2AF (n) described below.

The CPU obtains the air-fuel sensor output Vabyfs every time the constant sampling time period "ts" elapses. This constant sampling time period "ts" may be a time period obtained through dividing a predetermined time period by a natural number, the predetermined time period being an interval of obtaining the second-order differential value obtained every elapse of a predetermined time period in one combustion cycle time period. The predetermined time period, however, is usually the same as the sampling time period "ts".

The CPU obtains, as a "currently-detected air-fuel ratio change rate d1AF(n)", a value obtained by subtracting from a "currently-detected air-fuel ratio abyfs(n)" represented by a "newly-obtained air-fuel ratio sensor output Vabyfs" a "previously-detected air-fuel ratio abyfs(n−1)" represented by a "air-fuel ratio sensor output obtained at a time point the sampling time period "ts" before" (step 1010 to step 1030, step 1050, and step 1060 of FIG. 10 and FIG. 12).

Further, the CPU obtains, as the "second-order differential value d2AF(n)", a value obtained by subtracting from a "newly-obtained currently-detected air-fuel ratio change rate d1AF(n)" a "previously-detected air-fuel ratio change rate d1AF(n−1) obtained the sampling time period "ts" before" (step 1040 and 1060 of FIG. 10 and FIG. 12).

Also, the CPU of each of the above-mentioned determining apparatuses may obtain the second-order differential value d2AF(n) described below.

(1) The CPU obtains the air-fuel sensor output Vabyfs every time the constant sampling time period "ts" elapses.

(2) The CPU obtains, as a "currently-detected air-fuel ratio change rate d1AF(n), a value obtained by subtracting from a "currently-detected air-fuel ratio abyfs(n) represented by a newly-obtained air-fuel ratio sensor output" a "previously-detected air-fuel ratio abyfs(n−1) represented by an air-fuel ratio sensor output obtained at a timing the sampling time period before". The CPU stores (holds), as a detected air-fuel ratio change rate d1AF(n), the obtained detected air-fuel ratio change rate d1AF(n) while relating it to an obtaining order Cn of the detected air-fuel ratio change rates in one unit combustion cycle period.

(3) When one unit combustion cycle period has passed, the CPU obtains, as an increasing-side detected air-fuel ratio change rate average value AvePd1AF, an "average value of change rates of the detected air-fuel rates, each having a positive value" among a plurality of the detected air-fuel ratio change rates d1AF(Cn) obtained within that unit combustion cycle period.

(4) Similarly, the CPU obtains, as a decreasing-side detected air-fuel ratio change rate average value AveMd1AF, an "average value of change rates of the detected air-fuel rates, each having a negative value" among a plurality of the detected air-fuel ratio change rates d1AF(Cn) obtained within that unit combustion cycle period.

(5) The CPU obtains, as a "second-order differential value d2AF within that unit combustion cycle period", a difference (for example, AvePd1AF-AveMd1AF, or AveMd1AF-AvePd1AF) between the increasing-side detected air-fuel ratio change rate average value AvePd1AF and the decreasing-side detected air-fuel ratio change rate average value AveMd1AF.

Thereafter, the CPU obtains, as an air-fuel ratio second-order differential corresponding value HD2AF, the above-obtained second-order differential value d2AF within that unit combustion cycle period. The CPU determines that air-fuel ratio imbalance state among cylinders has occurred when an absolute value |HD2AF| is larger than the first threshold value Th1.

It should be noted that the present invention is not limited to the above-mentioned embodiments, but various modifications can be adopted within the scope of the present invention. For example, an air-fuel ratio imbalance among cylinders determining apparatus according to the present invention may be configured so as to determine whether or not an air-fuel ratio imbalance state among cylinders is occurring, using the above-mentioned technique every time one unit combustion cycle period elapses, and to determine that the air-fuel ratio imbalance state among cylinders has occurred, when determinations of occurrence of the air-fuel ratio imbalance state among cylinders are made for consecutive unit combustion cycle periods.

Also, the detected air-fuel ratio change rate d1AF(n) is obtained as a first-order differential value of the detected air-fuel ratio abyfs represented by the air-fuel ratio sensor output Vabyfs with respect to time, but the detected air-fuel ratio change rate d1AF(n) may be obtained by obtaining a first-order differential value of the air-fuel ratio sensor output Vabyfs with respect to time, and by converting it into a value corresponding to the air-fuel ratio.

The invention claimed is:

1. An air-fuel ratio imbalance among cylinders determining apparatus, applied to a multi-cylinder internal combustion engine having a plurality of cylinders, for determining whether or not an air-fuel ratio imbalance state among cylinders is occurring, said state being a state in which an imbalance is occurring among individual cylinder air-fuel ratios, each of which is an air-fuel ratio of a mixture supplied to each of at least two cylinders of said plurality of cylinders, comprising:

an air-fuel ratio sensor, which is disposed at an exhaust gas aggregated portion of an exhaust gas passage of said engine where exhaust gases discharged from said at least two cylinders aggregate or is disposed at a portion downstream of said exhaust gas aggregated portion of said exhaust gas passage, and which generates, as an air-fuel ratio sensor output, an output corresponding to an air-fuel ratio of exhaust gas which has reached said air-fuel ratio sensor; and imbalance determining means for obtaining a second-order differential value of a detected air-fuel ratio represented by said air-fuel ratio sensor output with respect to time based on said air-fuel ratio sensor output, obtaining an air-fuel ratio second-order differential corresponding value varying in accordance with said obtained second-order differential value based on said obtained second-order differential value, and determining whether or not said air-fuel ratio imbalance state among cylinders is occurring based on said obtained air-fuel ratio second-order differential corresponding value, wherein said imbalance determining means is configured so as to determine that said air-fuel ratio imbalance state among cylinders is occurring when an absolute value of said obtained air-fuel ratio second-order differential corresponding value is larger than a first threshold value, and wherein said imbalance determining means is configured so as to obtain said second-order differential value obtained every elapse of a predetermined time period in a unit combustion cycle period required for an arbitrary one of said at least two cylinders to complete one combustion cycle formed of an intake stroke, a compression stroke, an expansion stroke, and an exhaust gas stroke, and so as to obtain, as said air-fuel ratio second-order differential corresponding value, a second-order differential value whose absolute value is largest among a plurality of said second-order differential values obtained in said unit combustion cycle period.

2. An air-fuel ratio imbalance among cylinders determining apparatus, applied to a multi-cylinder internal combustion engine having a plurality of cylinders, for determining whether or not an air-fuel ratio imbalance state among cylinders is occurring, said state being a state in which an imbalance is occurring among individual cylinder air-fuel ratios, each of which is an air-fuel ratio of a mixture supplied to each of at least two cylinders of said plurality of cylinders, comprising:

an air-fuel ratio sensor, which is disposed at an exhaust gas aggregated portion of an exhaust gas passage of said engine where exhaust gases discharged from said at least two cylinders aggregate or is disposed at a portion downstream of said exhaust gas aggregated portion of said exhaust gas passage, and which generates, as an air-fuel ratio sensor output, an output corresponding to an air-fuel ratio of exhaust gas which has reached said air-fuel ratio sensor; and imbalance determining means for obtaining a second-order differential value of a detected air-fuel ratio represented by said air-fuel ratio sensor output with respect to time based on said air-fuel ratio sensor output, obtaining an air-fuel ratio second-order differential corresponding value varying in accordance with said obtained second-order differential value based on said obtained second-order differential value, and determining whether or not said air-fuel ratio imbalance state among cylinders is occurring based on said obtained air-fuel ratio second-order differential corresponding value, wherein said imbalance determining means is configured so as to:

obtain, as said air-fuel ratio second-order differential corresponding values, said second-order differential value obtained every elapse of a predetermined time period in a unit combustion cycle period required for an arbitrary one of said at least two cylinders to complete one combustion cycle formed of an intake stroke, a compression stroke, an expansion stroke, and an exhaust gas stroke; and determine that said air-fuel ratio imbalance state among cylinders is occurring, when an air-fuel ratio second-order differential corresponding value having a positive value whose absolute value is larger than or equal to a second threshold value exists, and an air-fuel ratio second-order differential corresponding value having a negative value whose absolute value is larger than or equal to a third threshold value exists, among a plurality of said air-fuel ratio second-order differential corresponding values obtained in said unit combustion cycle period.

3. An air-fuel ratio imbalance among cylinders determining apparatus, applied to a multi-cylinder internal combustion engine having a plurality of cylinders, for determining whether or not an air-fuel ratio imbalance state among cylinders is occurring, said state being a state in which an imbalance is occurring among individual cylinder air-fuel ratios, each of which is an air-fuel ratio of a mixture supplied to each of at least two cylinders of said plurality of cylinders, comprising:

an air-fuel ratio sensor, which is disposed at an exhaust gas aggregated portion of an exhaust gas passage of said engine where exhaust gases discharged from said at least two cylinders aggregate or is disposed at a portion downstream of said exhaust gas aggregated portion of said exhaust gas passage, and which generates, as an air-fuel ratio sensor output, an output corresponding to an air-fuel ratio of exhaust gas which has reached said air-fuel ratio sensor; and imbalance determining means for obtaining a second-order differential value of a detected air-fuel ratio represented by said air-fuel ratio sensor output with respect to time based on said air-fuel ratio sensor output, obtaining an air-fuel ratio second-order differential corresponding value varying in accordance with said obtained second-order differential value based on said obtained second-order differential value, and determining whether or not said air-fuel ratio imbalance state among cylinders is occurring based on said obtained air-fuel ratio second-order differential corresponding value, wherein said imbalance determining means is configured so as to:

obtain, as said air-fuel ratio second-order differential corresponding values, said second-order differential value obtained every elapse of a predetermined time period in a unit combustion cycle period required for an arbitrary one of said at least two cylinders to complete one combustion cycle formed of an intake stroke, a compression stroke, an expansion stroke, and an exhaust gas stroke; and select a positive-side maximum air-fuel ratio differential corresponding value whose absolute value is largest from air-fuel ratio differential corresponding values, each having a positive value, among a plurality of said air-fuel ratio second-order differential corresponding values obtained within said unit combustion cycle period;

select a negative-side maximum air-fuel ratio differential corresponding value whose absolute value is largest from air-fuel ratio differential corresponding values, each having a negative value, among a plurality of said air-fuel ratio second-order differential corresponding values obtained within said unit combustion cycle period; and further, determine that said air-fuel ratio imbalance state among cylinders is occurring when a product of said positive-side maximum second-order differential corresponding value and said negative-side maximum second-order differential corresponding value is equal to or smaller than a predetermined negative threshold value.

4. The air-fuel ratio imbalance determining apparatus among cylinders according to any one of claims 1 to 3, wherein said imbalance determining means is configured so as to:

obtain said second-order differential values of said detected air-fuel ratio with respect to time, said second-order differential value being obtained every elapse of a predetermined time period within a unit combustion cycle period required for an arbitrary one of said at least two cylinders to complete one combustion cycle formed of an intake stroke, a compression stroke, an expansion stroke, and an exhaust gas stroke;

obtain, when a latest unit combustion cycle period has passed, a first time point at which a positive-side maximum second-order differential value whose absolute value is largest emerged, among second-order differential values, each having a positive value, out of a plurality of the second-order differential values obtained within said latest unit combustion cycle period;

obtain, when said latest unit combustion cycle period has passed, a second time point at which a negative-side maximum second-order differential value whose absolute value is largest emerged, among second-order differential values, each having a negative value, out of a plurality of said second-order differential values obtained within said latest unit combustion cycle period;

obtain, when a unit combustion cycle period immediately before said latest unit combustion cycle period has passed, a third time point at which a positive-side maximum second-order differential value whose absolute value is largest emerged, among second-order differential values, each having a positive value, out of a plurality of second-order differential values obtained within said unit combustion cycle period immediately before said latest unit combustion cycle period;

obtain, when said unit combustion cycle period immediately before said latest unit combustion cycle period has passed, a fourth time point at which a negative-side maximum second-order differential value whose absolute value is largest emerged, among second-order differential values, each having a negative value, out of a plurality of said second-order differential values obtained within said unit combustion cycle period immediately before said latest unit combustion cycle period;

in a case where it is determined that said air-fuel ratio imbalance state among cylinders is occurring, when said first time point is before said second time point, obtain, as a first time period, a time period from said first time point to said second time point, and obtain, as a second time period, a time period from said fourth timing to said first timing;

when said first time point is after said second time point, obtain, as said first time period, a time period from said third time point to said second time period, and obtain, as said second time period, a time period from said second time point to said first time point;

when said obtained first time period is longer than said obtained second time period, determine that an air-fuel ratio imbalance state has occurred where an air-fuel ratio of one cylinder of said at least two cylinders has deviated on a richer side with respect to a stoichiometric air-fuel ratio; and when said second time period is longer than said first time period, determine that an air-fuel ratio imbalance state has occurred where an air-fuel ratio of one cylinder of said at least two cylinders has deviated on a leaner side with respect to the stoichiometric air-fuel ratio.

5. An air-fuel ratio imbalance among cylinders determining apparatus, applied to a multi-cylinder internal combustion engine having a plurality of cylinders, for determining whether or not an air-fuel ratio imbalance state among cylinders is occurring, said state being a state in which an imbalance is occurring among individual cylinder air-fuel ratios, each of which is an air-fuel ratio of a mixture supplied to each of at least two cylinders of said plurality of cylinders, comprising:

an air-fuel ratio sensor, which is disposed at an exhaust gas aggregated portion of an exhaust gas passage of said engine where exhaust gases discharged from said at least two cylinders aggregate or is disposed at a portion downstream of said exhaust gas aggregated portion of said exhaust gas passage, and which generates, as an air-fuel ratio sensor output, an output corresponding to an air-fuel ratio of exhaust gas which has reached said air-fuel ratio sensor; and imbalance determining means for obtaining a second-order differential value of a detected air-fuel ratio represented by said air-fuel ratio sensor output with respect to time based on said air-fuel ratio sensor output, obtaining an air-fuel ratio second-order differential corresponding value varying in accordance with said obtained second-order differential value based on said obtained second-order differential value, and determining whether or not said air-fuel ratio imbalance state among cylinders is occurring based on said obtained air-fuel ratio second-order differential corresponding value, wherein said imbalance determining means is configured so as to:

obtain said second-order differential values of said detected air-fuel ratio with respect to time, said second-order differential value being obtained every elapse of a predetermined time period within a unit combustion cycle period required for an arbitrary one of said at least two cylinders to complete one combustion cycle formed of an intake stroke, a compression stroke, an expansion stroke, and an exhaust gas stroke;

identify a time point when a positive-side maximum air-fuel ratio second-order differential value whose absolute value is largest emerges out of air-fuel ratio second-order differential values, each having a positive value, among a plurality of said air-fuel ratio second-order differential values obtained within said unit combustion cycle period; and determine, based on said identified time point, which air-fuel ratio of a cylinder of said at least two cylinders is abnormal, when it is determined that said air-fuel ratio imbalance state among cylinders is occurring.

6. An air-fuel ratio imbalance among cylinders determining apparatus, applied to a multi-cylinder internal combustion engine having a plurality of cylinders, for determining whether or not an air-fuel ratio imbalance state among cylinders is occurring, said state being a state in which an imbalance is occurring among individual cylinder air-fuel ratios, each of which is an air-fuel ratio of a mixture supplied to each of at least two cylinders of said plurality of cylinders, comprising:

an air-fuel ratio sensor, which is disposed at an exhaust gas aggregated portion of an exhaust gas passage of said engine where exhaust gases discharged from said at least two cylinders aggregate or is disposed at a portion downstream of said exhaust gas aggregated portion of said exhaust gas passage, and which generates, as an air-fuel ratio sensor output, an output corresponding to an air-fuel ratio of exhaust gas which has reached said air-fuel ratio sensor; and imbalance determining means for obtaining a second-order differential value of a detected air-fuel ratio represented by said air-fuel ratio sensor output with respect to time based on said air-fuel ratio sensor output, obtaining an air-fuel ratio second-order differential corresponding value varying in accordance with said obtained second-order differential value based on said obtained second-order differential value, and determining whether or not said air-fuel ratio imbalance state among cylinders is occurring based on said obtained air-fuel ratio second-order differential corresponding value, wherein said imbalance determining means is configured so as to:

obtain said second-order differential values of said detected air-fuel ratio with respect to time, said second-order differential value being obtained every elapse of a predetermined time period within a unit combustion cycle period required for an arbitrary one of said at least two cylinders to complete one combustion cycle formed of an intake stroke, a compression stroke, an expansion stroke, and an exhaust gas stroke;

identify a time point when a negative-side maximum air-fuel ratio second-order differential value whose absolute value is largest emerges out of air-fuel ratio second-order differential values, each having a negative value, among a plurality of said air-fuel ratio second-order differential values obtained within said unit combustion cycle period; and determine, based on said identified time point, which air-fuel ratio of a cylinder of said at least two cylinders is abnormal, when it is determined that said air-fuel ratio imbalance state among cylinders is occurring.

7. An air-fuel ratio imbalance among cylinders determining apparatus, applied to a multi-cylinder internal combustion engine having a plurality of cylinders, for determining whether or not an air-fuel ratio imbalance state among cylinders is occurring, said state being a state in which an imbalance is occurring among individual cylinder air-fuel ratios, each of which is an air-fuel ratio of a mixture supplied to each of at least two cylinders of said plurality of cylinders, comprising:

an air-fuel ratio sensor, which is disposed at an exhaust gas aggregated portion of an exhaust gas passage of said engine where exhaust gases discharged from said at least two cylinders aggregate or is disposed at a portion downstream of said exhaust gas aggregated portion of said exhaust gas passage, and which generates, as an air-fuel ratio sensor output, an output corresponding to an air-fuel ratio of exhaust gas which has reached said air-fuel ratio sensor; and imbalance determining means for obtaining a second-order differential value of a detected air-fuel ratio represented by said air-fuel ratio sensor output with respect to time based on said air-fuel ratio sensor output, obtaining an air-fuel ratio second-order differential corresponding value varying in accordance with said obtained second-order differential value based on said obtained second-order differential value, and determining whether or not said air-fuel ratio imbalance state among cylinders is occurring based on said obtained air-fuel ratio second-order differential corresponding value, wherein said imbalance determining means is configured so as to determine that said air-fuel ratio imbalance state among cylinders is occurring when an absolute value of said obtained air-fuel ratio second-order differential corresponding value is larger than a first threshold value, and wherein said imbalance determining means is configured so as to:

obtain said air-fuel sensor output every time a constant sampling time period elapses;

obtain, as a detected air-fuel ratio change rate, a value obtained by subtracting a previously-detected air-fuel ratio represented by said air-fuel ratio sensor output obtained said sampling time period before from a currently-detected air-fuel ratio represented by said air-fuel ratio sensor output newly obtained;

obtain a value, as an increasing-side detected air-fuel ratio change rate average value, said value being an average value of said detected air-fuel ratio change rates, each having a positive value, among a plurality of said detected air-fuel ratio change rates obtained within a unit combustion cycle period required for an arbitrary one of said at least two cylinders to complete one combustion cycle formed of an intake stroke, a compression stroke, an expansion stroke, and an exhaust gas stroke;

obtain a value, as a decreasing-side detected air-fuel ratio change rate average value, said value being an average value of said detected air-fuel ratio change rates, each having a negative value, among a plurality of said detected air-fuel ratio change rates obtained within said unit combustion cycle period; and obtain, as said second-order differential value, a difference between said increasing-side detected air-fuel ratio change rate average value and said decreasing-side detected air-fuel ratio change rate average value.

* * * * *